US011554456B1

(12) United States Patent
Baker et al.

(10) Patent No.: US 11,554,456 B1
(45) Date of Patent: Jan. 17, 2023

(54) SHARPENER WITH SWING ARM ABRASIVE ASSEMBLY

(71) Applicant: Darex, LLC, Ashland, OR (US)

(72) Inventors: Steven L. Baker, Medford, OR (US); Conner S. MacFarlane, Bend, OR (US); Joseph T. Zachariasen, Medford, OR (US); Daniel T. Dovel, Shady Cove, OR (US); Travis Campbell, Medford, OR (US)

(73) Assignee: Darex, LLC, Ashland, OR (US)

( * ) Notice: Subject to any disclaimer, the term of this patent is extended or adjusted under 35 U.S.C. 154(b) by 0 days.

(21) Appl. No.: 17/480,815

(22) Filed: Sep. 21, 2021

(51) Int. Cl.
*B24B 3/54* (2006.01)
*B24B 41/02* (2006.01)

(52) U.S. Cl.
CPC ..... *B24B 3/543* (2013.01); *B24B 41/02* (2013.01)

(58) Field of Classification Search
CPC .... B24B 3/00; B24B 3/36; B24B 3/52; B24B 3/54; B24B 3/546; B24B 3/605; B24D 15/02; B24D 15/06; B24D 15/063; B24D 15/065; B24D 15/08
USPC ..... 451/45, 371, 372, 552, 555; 76/82, 82.2, 76/84, 86; 7/120; 30/138
See application file for complete search history.

(56) References Cited

U.S. PATENT DOCUMENTS 308,046 A 11/1884 Williams
1,148,303 A 7/1915 Farrar
1,368,218 A 2/1921 Chenette
1,832,968 A 11/1931 De Armey
1,935,592 A * 11/1933 Stivers ..... B24D 15/06 451/554
2,191,899 A 2/1940 Primak
2,557,093 A 6/1951 Garbarino
2,604,738 A 7/1952 Ramey
3,654,823 A 4/1972 Juranitch
3,733,933 A 5/1973 Longbrake
3,800,632 A 4/1974 Juranitch
(Continued)

FOREIGN PATENT DOCUMENTS

AU 204125 B 2/1956
DE 102005033806 A1 8/2006
(Continued)

OTHER PUBLICATIONS

"User Manual for the Ermak-10 knife sharpener"; https://sharpeningtool.eu/sites/default/files/temp/instrukcia_e10_en.pdf; obtained from the VETAKO website on Mar. 14, 2022; 6 pages.

*Primary Examiner* — Joseph J Hail
*Assistant Examiner* — Alberto Saenz
(74) *Attorney, Agent, or Firm* — Workman Nydegger

(57) ABSTRACT

Method and apparatus for sharpening a cutting edge of a cutting tool, such as a kitchen knife. In some embodiments, an abrasive assembly has a frame, a handle, and a cartridge that supports a plurality of abrasive members each having an associated abrasive surface. A rod affixes the abrasive assembly to a base assembly to facilitate movement of the abrasive assembly along the cutting edge of the tool responsive to engagement, by a user, of the user handle. Each abrasive member is configured to be moved, by the user, with respect to the handle to present each abrasive surface in turn. In some cases, the cartridge is rotatable about a cartridge axis that may be parallel or non-parallel to a central axis of the rod.

21 Claims, 25 Drawing Sheets

(56) References Cited

U.S. PATENT DOCUMENTS

| | | | | |
|---|---|---|---|---|
| 3,913,903 | A | 10/1975 | Seward et al. | |
| 3,924,360 | A | 12/1975 | Haile et al. | |
| 4,216,627 | A | 8/1980 | Westrom | |
| 4,320,892 | A | 3/1982 | Longbrake | |
| 4,404,873 | A | 9/1983 | Longbrake | |
| 4,441,279 | A | 4/1984 | Storm et al. | |
| 4,471,951 | A | 9/1984 | Levine | |
| 4,486,982 | A | 12/1984 | Longbrake | |
| 4,497,142 | A | 2/1985 | Sessoms | |
| 4,512,112 | A | 4/1985 | Levine | |
| 4,777,770 | A | 10/1988 | Levine | |
| 5,185,958 | A * | 2/1993 | Dale | B24D 15/06 451/558 |
| 5,195,275 | A | 3/1993 | McLean | |
| 5,363,602 | A | 11/1994 | Anthon et al. | |
| 5,431,068 | A | 7/1995 | Alsch | |
| D363,202 | S | 10/1995 | Ross | |
| 5,472,375 | A | 12/1995 | Pugh | |
| 5,547,419 | A | 8/1996 | Hulnicki | |
| 6,227,958 | B1 | 5/2001 | Neuberg | |
| 6,579,163 | B1 * | 6/2003 | Ross | B24B 3/36 451/540 |
| 7,052,385 | B1 | 5/2006 | Swartz | |
| 7,144,310 | B2 | 12/2006 | Longbrake | |
| 7,182,678 | B2 | 2/2007 | Keska | |
| 7,867,062 | B2 | 1/2011 | Swartz | |
| 8,262,438 | B1 | 9/2012 | Allison | |
| 8,277,291 | B2 * | 10/2012 | Dovel | B24B 3/38 451/551 |
| 8,292,701 | B2 | 10/2012 | Heng | |
| 8,303,381 | B2 * | 11/2012 | Schwartz | B24D 15/105 451/371 |
| 8,323,077 | B2 | 12/2012 | Nakoff | |
| 9,216,488 | B2 * | 12/2015 | Allison | B24B 3/54 |
| 10,131,028 | B1 | 11/2018 | Allison | |
| 10,201,884 | B2 | 2/2019 | Sandefur | |
| 2014/0342644 | A1 | 11/2014 | Hasegawa | |

FOREIGN PATENT DOCUMENTS

| | | | |
|---|---|---|---|
| WO | 2004037488 | A1 | 5/2004 |
| WO | 2017200431 | A1 | 11/2017 |

* cited by examiner

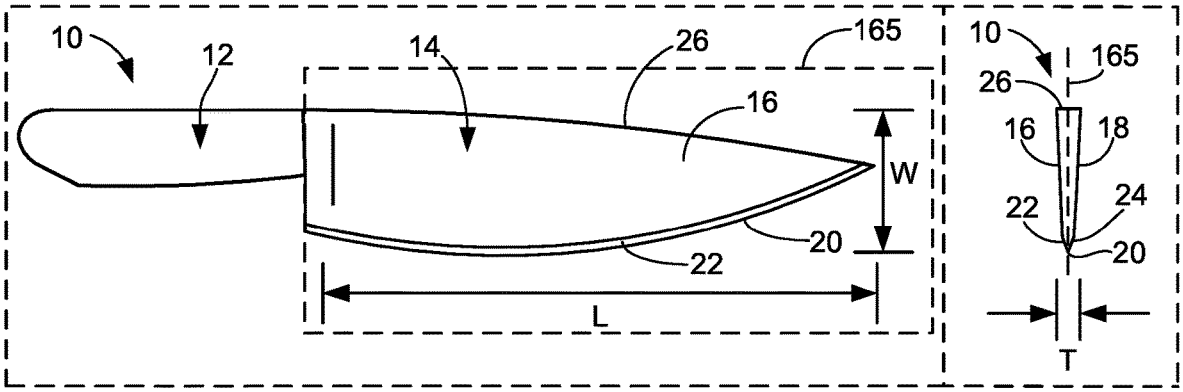
FIG. 1A
Related Art
FIG. 1B
Related Art
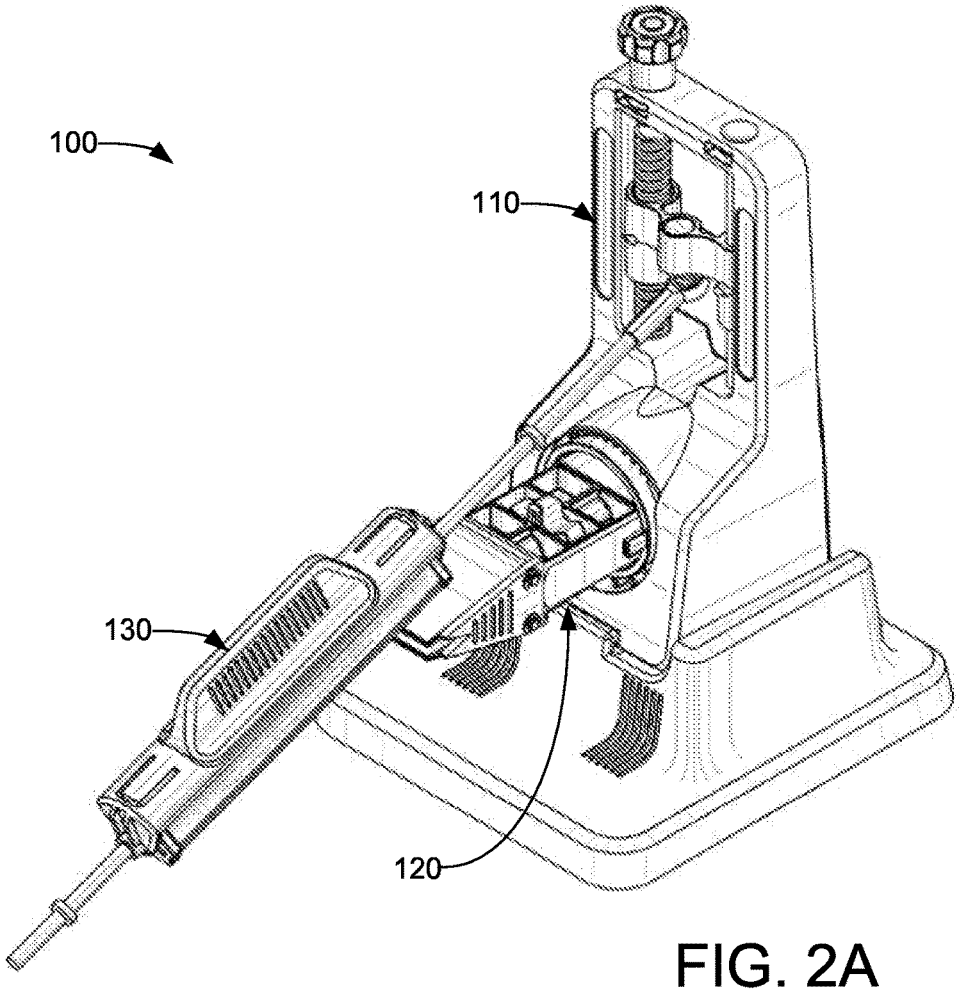
FIG. 2A

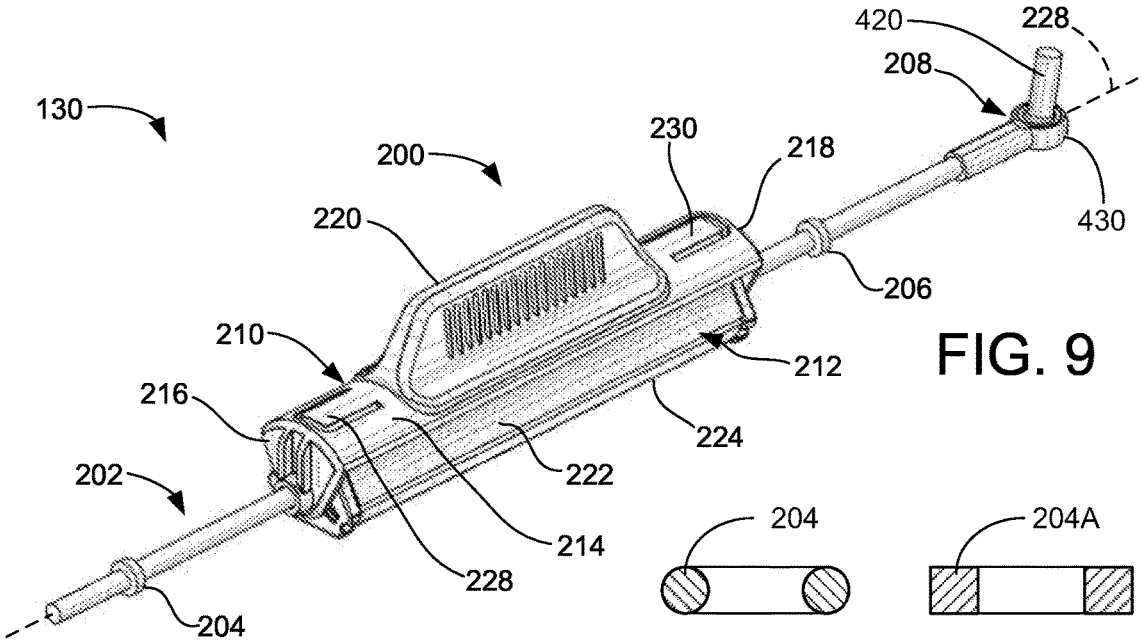
FIG. 9
FIG. 9A
FIG. 9B
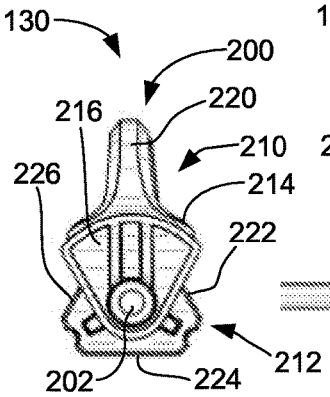
FIG. 10A
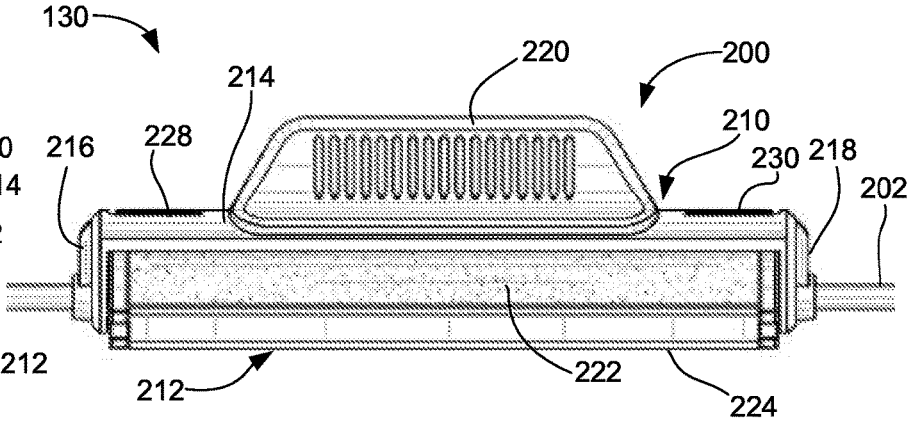
FIG. 10B
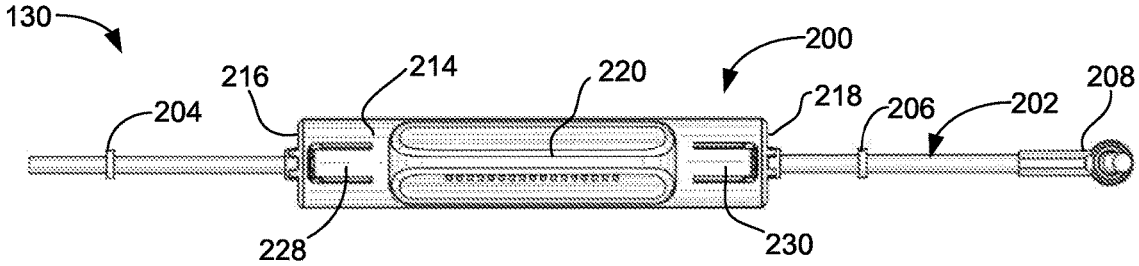
FIG. 10C

SHARPENER WITH SWING ARM ABRASIVE ASSEMBLY

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as many types of conventional kitchen knives, the opposing surfaces are generally symmetric; other cutting tools, such as many types of scissors and chisels, have a first opposing surface that extends in a substantially normal direction, and a second opposing surface that is skewed with respect to the first surface.

Complex blade geometries can be used, such as multiple sets of bevels at different respective angles that taper to the cutting edge. Scallops or other discontinuous features can also be provided along the cutting edge, such as in the case of serrated knives.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, abrasive belts, etc. Nevertheless, there remains a continual need for improved sharpener configurations that can provide accurate and repeatable sharpening operations.

SUMMARY

Various embodiments are directed to an apparatus and method for sharpening a cutting edge of a cutting tool, such as a kitchen knife.

In some embodiments, an abrasive assembly is provided for sharpening a cutting edge of a tool, with the abrasive assembly comprising a frame, a user handle coupled to the frame, and an abrasive cartridge secured to the frame. The abrasive cartridge has a plurality of abrasive members with associated abrasive surfaces. Each of the associated abrasive surfaces is configured to be selectable with respect to the user handle, by a user, to be presented in a facing relation to the cutting tool. A swing-arm rod extends from the frame along a rod axis and is configured for attachment to a base assembly. The rod facilitates movement of the user selected abrasive surface along the cutting edge of the tool responsive to engagement, by the user, of the user handle.

In other embodiments, a sharpener is provided for sharpening a cutting edge of a cutting tool. The sharpener includes a blade fixture configured to secure a blade of the cutting tool. A base assembly is configured to position the blade fixture at an orientation to the base assembly. An abrasive assembly has a frame with a user handle, an abrasive cartridge supported by the frame comprising a plurality of abrasive members with associated abrasive surfaces, and a swing arm rod which couples the frame to the base assembly at a selected sharpening angle. Each selected abrasive member can be moved into position with respect to the handle in facing relation to the cutting tool by a user. The abrasive assembly is configured for movement, by the user, of the associated abrasive surface of the selected abrasive member along the cutting edge of the cutting tool to impart a sharpening operation to a side of the blade thereon.

Further embodiments provide a method for sharpening a cutting edge of a cutting tool. The method can be characterized as including steps of securing a blade of the cutting tool in a blade fixture, the blade fixture supported by a base assembly of the sharpener; selecting a first abrasive surface of an abrasive assembly, the abrasive assembly comprising a frame with a user handle, an abrasive cartridge supported by the frame, and a swing arm rod which couples the frame to the base assembly at a selected sharpening angle, the abrasive cartridge comprising a plurality of abrasive members with associated abrasive surfaces, the first abrasive surface selected by moving the cartridge with respect to the frame such that the first abrasive surface is brought into a facing engagement with a side of the blade at the selected sharpening angle; advancing, via the user handle, the abrasive assembly along an arcuate path defined by the rod, engaging a side of the blade with the first abrasive surface to sharpen a side of the blade at the selected sharpening angle; selecting a second abrasive surface, different than the first, by moving the cartridge with respect to the frame such that the second abrasive surface is brought into a facing engagement with a side of the blade at the selected sharpening angle; and advancing, via the user handle, the abrasive assembly along an arcuate path defined by the rod, engaging a side of the blade with the second abrasive surface to sharpen a side of the blade at a second selected sharpening angle.

These and other features and advantages of various embodiments can be understood from a review of the following detailed description in conjunction with the accompanying drawings.

BRIEF DESCRIPTION OF DRAWINGS

FIGS. 1A and 1B illustrate a cutting tool in the form of a kitchen knife in accordance with the related art that can be sharpened by various embodiments of the present disclosure.

FIGS. 2A, 2B and 2C show respective views of a manual cutting tool sharpener constructed and operated in accordance with various embodiments of the present disclosure. FIG. 2A is an isometric view of the sharpener, FIG. 2B is a side view, and FIG. 2C is a top plan view.

FIG. 9 shows an isometric depiction of a removable abrasive assembly of the sharpener of FIGS. 2A-2C in some embodiments.

FIGS. 9A and 9B show alternative constructions for a limit stop member from FIG. 9.

FIGS. 10A through 10C show alternative views of the abrasive assembly.

DETAILED DESCRIPTION

Figure 2B:
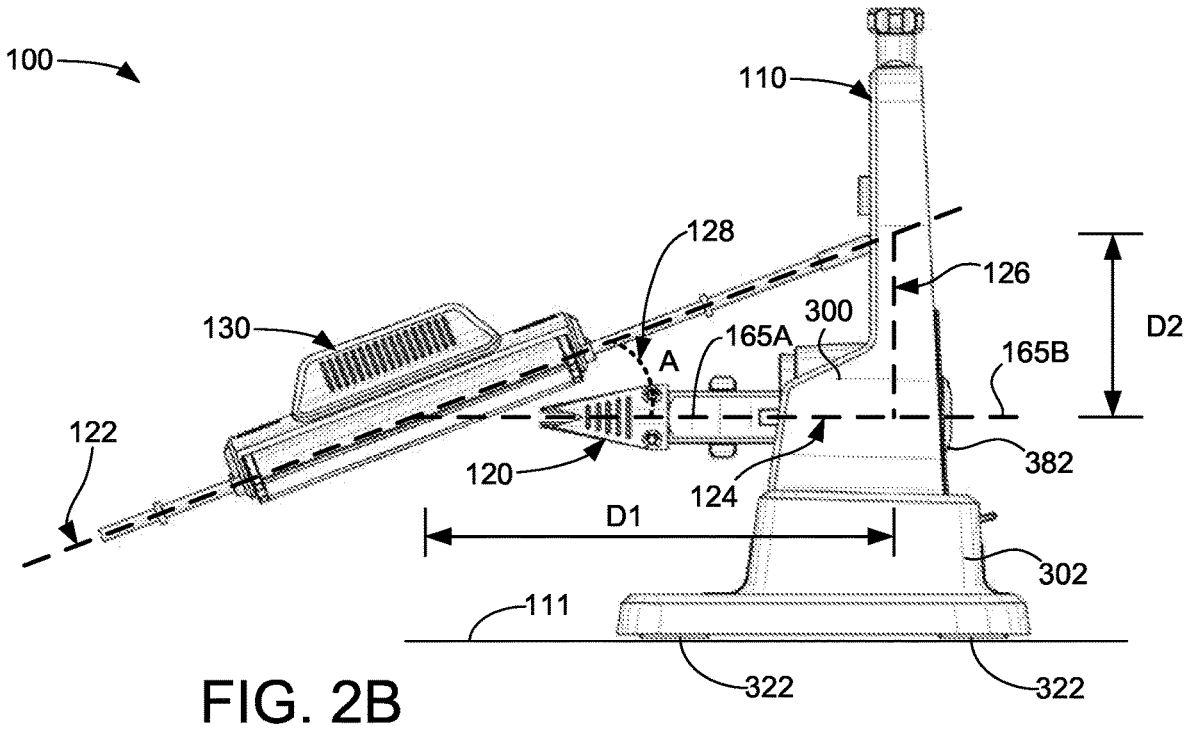

Various embodiments of the present disclosure are generally directed to a novel manual tool sharpener and a method of use thereof. The sharpener is adapted to sharpen any number of different types of cutting tools, including but not limited to kitchen knives, pocket knives, Bowie knives, pen knives, stilettos, scissors, daggers, dirks, swords, axes, etc. Other forms of cutting tools can be sharpened by the system as well.

Some embodiments provide the sharpener with a base assembly configured to be supported on a horizontal support surface, such as a counter or a workstation surface.

The base assembly supports a blade fixture which is configured to be inserted into a receiving slot of the base assembly at a precise, controlled orientation. The blade fixture has a pair of opposing clamping jaws configured to contactingly grasp (clamp) opposing sides of a blade of a cutting tool, such as but not limited to a kitchen knife.

An abrasive assembly is provided to sharpen a cutting edge of the blade once the blade is installed into the fixture and the fixture has been installed into the base assembly. The abrasive assembly is characterized as a swing-arm type module connected at the end of a swing arm (rod) mounted to the base assembly. The abrasive assembly includes an abrasive block that is affixed to the rod. The abrasive block supports at least one abrasive member with a corresponding abrasive surface. The abrasive surface is presented in a direction facing the blade.

To sharpen the blade, the user moves the abrasive block via a user handle along a controlled arcuate path established by the rod and the contour of the cutting edge of the blade. This causes the abrasive surface to contactingly engage a side of the blade at a selected sharpening angle. The arcuate path can be thought of as a contoured planar path that generally follows the contour of the cutting edge as defined by the angle and distance of the swing arm with respect to the base assembly.

In some embodiments, the abrasive assembly includes a cartridge that supports multiple abrasive members. It is contemplated that a total of three (3) abrasive members will be provided in the cartridge, but other numbers of members can be used, including less or more than three. The user can rotate the cartridge to select the appropriate abrasive member for a desired sharpening operation. In other embodiments, the abrasive assembly is configured to support abrasive members in the form of plates that can be removed and attached as required.

Different sharpening operations can be carried out with abrasive members having different abrasiveness (grit) levels. In one non-limiting embodiment, the abrasives are supplied with grits of 320, 600 and 1200. Other respective values can be used. Replaceable cartridges of abrasive members can be installed into the abrasive assembly as desired. Conformable media can be used.

The use of different abrasiveness levels allows different types of sharpening operations to be successively applied to the cutting tool. In one example, a coarse sharpening operation can be initially applied to a blade, followed by fine and honing sharpening operations to dress and finalize the blade geometry. Different angles can be applied to each of the coarse, fine and honing sharpening operations. While ceramic or coated abrasive members are envisioned, substantially any form of abrasive material, including a leather strop, ceramic, diamond coated plates, sandpaper media, etc. can be supplied. Moreover, while the abrasive members are contemplated as being rectilinear and flat, other shapes can be used including curved, cylindrical, etc. In some cases, a layer of abrasive media may be supported by a compliant layer, such as a layer of open or closed cell foam, rubber, etc., to provide compliance to the sharpening operation.

The abrasive assembly can be provided with a spring feature that biases an associated abrasive member at a selected orientation. Alternatively, the associated abrasive member can be configured to move with respect to the user handle to nominally follow the contour of the cutting edge of the blade.

These and other features and advantages of various embodiments can be understood beginning with a review of FIGS. 1A and 1B, which provide schematic depictions of a cutting tool 10 of the related art. FIG. 1A is a side view and FIG. 1B is a partial end view. The tool 10 is characterized as a kitchen knife, although other forms of cutting tools can be sharpened by the various embodiments presented herein. The knife 10 includes a user handle 12 with an outer grip surface adapted to be grasped by a user during use of the knife. A blade 14 extends from the handle 12. The blade has opposing flat, elongated sides 16, 18. These sides 16, 18 converge to a cutting edge 20. The cutting edge 20 is defined by the convergence of opposing tapered sides, or bevels 22, 24 at distal ends of the sides 16, 18. The bevels taper to an intersecting line which defines the cutting edge 20. A back edge, or spine 26 extends opposite the cutting edge 20 between the opposing sides 16, 18.

For purposes of the present discussion, the spine 26 represents that portion of the blade opposite the cutting edge 20 being sharpened during a sharpening operation. In some cases, the spine of the blade will represent the thickest portion of the knife and may comprise a flat, non-cutting surface. In other cases, the spine of the blade may constitute other features, including one or more cutting edges opposite the cutting edge, a series of serrations, multiple different surfaces that extend at different angles, etc. Examples of a blade with a cutting edge along the spine includes a double sided blade (e.g., a dirk), a Bowie knife, etc.

It will be understood that elements 16 and 18 define the overall sides of the blade, and the bevels 22, 24 form portions of the sides 16, 18 but are contoured to converge to the cutting edge 20. The bevels 22, 24 can be linear, hollow ground, convex, segmented, etc. as described below. Although not shown in FIGS. 1A-1B, similar bevels to the bevels 22, 24 can be provide adjacent cutting edges supplied along the spine 26 as desired and formed using techniques disclosed herein.

The blade 14 has an overall width dimension W, which extends between and bisects the cutting edge 20 and the spine 26. The blade 14 further has an overall length dimension L, which extends along the length of the blade 14 from the handle to the tip of the blade. The width dimension W varies along the length dimension L, which will usually be the case unless the tool has a parallel configuration for the cutting edge 20 and the spine 26 such as with a meat cleaver, etc.

The blade further has an overall thickness dimension T, which is the largest distance between opposing sides 16, 18. A central blade plane 165 bisects the thickness dimension T of the blade 14 along the width dimension W, as shown in FIG. 1B. This plane 165 further extends along the length dimension L of the blade 14, as shown in FIG. 1A. Ideally, the central blade plane 165 will intersect the cutting edge 20 and the spine 26. To the extent that it does not due to various factors such as manufacturing imperfections, etc., the various embodiments can be used to reshape the knife or other cutting tool to achieve this desired alignment.

Figure 2C:
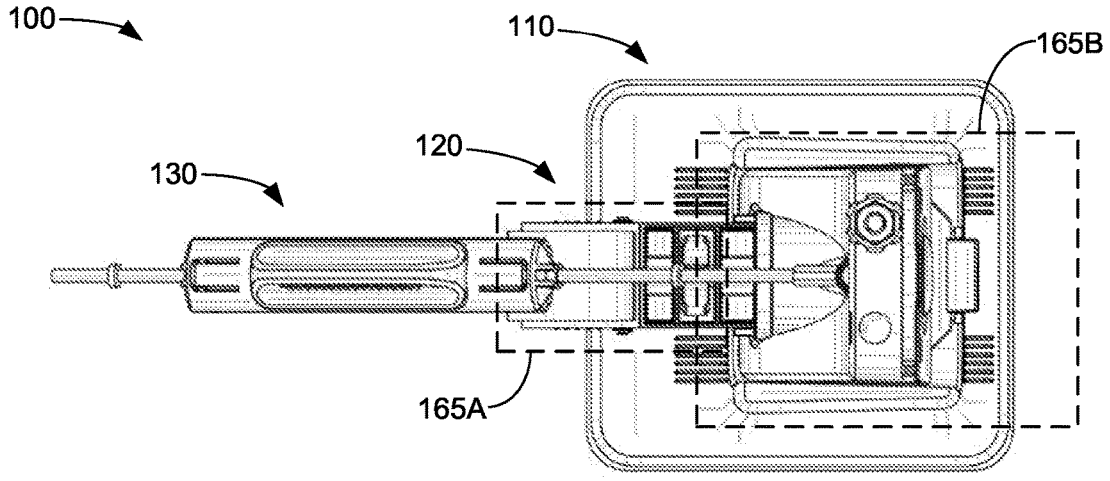

The knife 10 of FIGS. 1A and 1B, as well as other types and configurations of cutting tools, can be easily and precisely sharpened using a manual cutting tool sharpener 100, as depicted beginning in FIGS. 2A through 2C. FIG. 2A is an isometric view of the sharpener 100. FIG. 2B is a side elevational view of the sharpener 100. FIG. 2C is a top plan view of the sharpener 100.

The sharpener 100 includes a base assembly 110, which is configured to be supported on an underlying support surface, such as a work bench, as represented by surface 111 in FIG. 2B.

A removable blade fixture 120 is attachable to the base assembly 110 as shown to secure a cutting tool such as 10 in FIGS. 1A-1B. As explained below, the blade fixture 120 includes opposing jaw members which grasp opposing sides of the blade to be sharpened, such as side surfaces 16, 18 in FIG. 1B. This presents the cutting edge 20 (FIGS. 1A and 1B) in an outwardly directed orientation to enable sharpening by a removable abrasive assembly 130.

The abrasive assembly 130 is characterized as a swing arm type of sharpening assembly that is configured to be advanced along the cutting edge of the tool by the user once the tool is secured by the blade fixture 120 and mated into the base assembly 110. The abrasive assembly 130 includes multiple abrasive surfaces that can be successively selected by the user for presentation against the cutting edge (e.g., 20 in FIGS. 1A and 1B) to carry out various sharpening operations. Those skilled in the art will appreciate that during such sharpening, the abrasive assembly 130 will form/shape local surfaces such as the beveled surfaces 22, 24 in FIG. 1B in order to sharpen the cutting edge 20.

FIG. 2B shows certain geometries of interest. A triangular configuration is established by a central rod axis 122 that aligns along a presentation of the abrasive assembly 130, a horizontally extending axis 124 that bisects the blade fixture 120, and a vertically extending axis 126 that extends between the axes 122, 124. An intervening angle 128, denoted as angle A, extends between axes 122, 124. For reference, angle A represents an effective sharpening angle that is applied to the side of the blade being sharpened.

The sharpening angle A can be adjusted by raising or lowering a distal end of the abrasive assembly 130 relative to the base assembly 110. Other factors can affect this angle A as well, such as the distance along horizontal axis 124 at which the distal end (cutting edge) of the blade is disposed.

Various planes are nominally aligned along axis 124 based on the interaction of the blade fixture 120 with the base assembly 110. More specifically, the aforementioned central blade plane 165 (see FIGS. 1A-1B) is nominally aligned with a central fixture plane 165A of the blade fixture 120, as well as with a central base assembly plane 165B established by the base assembly 110. In this way, planes 165, 165A and 165B are all nominally parallel and aligned with the common axis 124 during operation. FIG. 2C shows top plan representations of the respective planes 165A and 165B, which are nominally coplanar.

For reference, distance D1 in FIG. 2B depicts the overall effective horizontal distance, or length, of axis 124 from a connection point of the base assembly 110 at which the abrasive assembly 130 is attached thereto, to the cutting edge of the blade which projects from the fixture 120. Distance D2 depicts the overall effective height of axis 126, which represents the vertical distance from the connection point of the base assembly to axis 124 (which nominally intersects the cutting edge of the blade).

Figure 3:
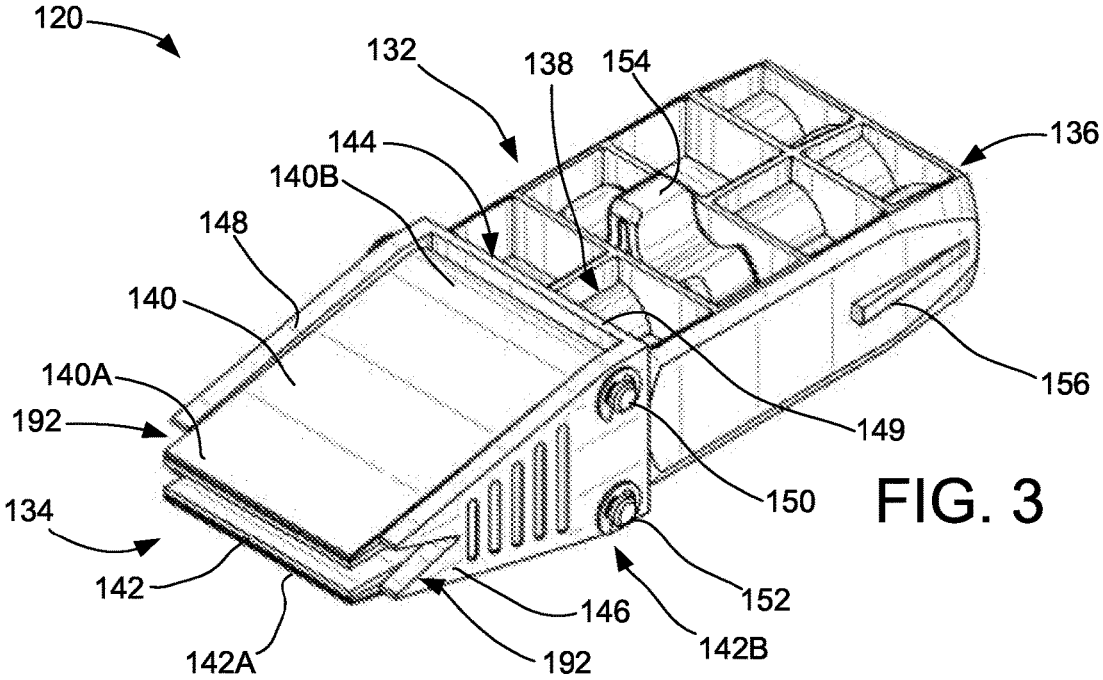
FIG. 3 is an isometric depiction of a removable blade fixture of the sharpener of FIGS. 2A-2C in in accordance with some embodiments.
Figure 4A:
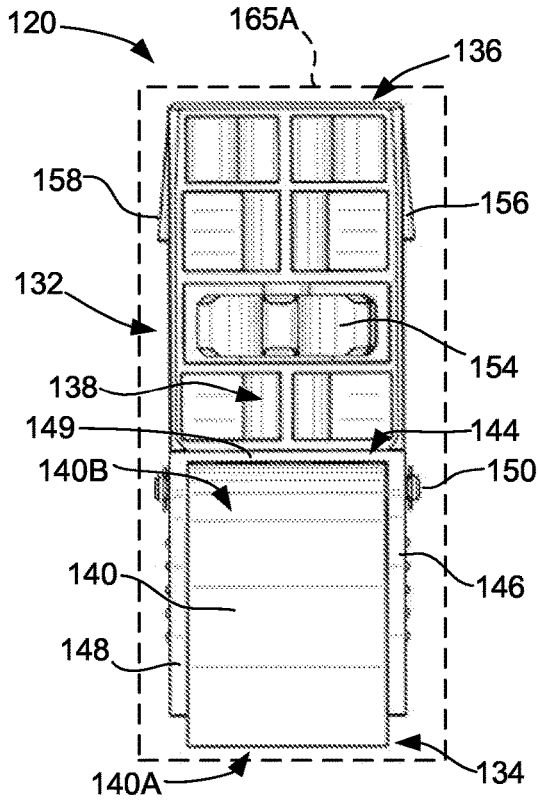
FIGS. 4A and 4B are top and side plan views of the blade fixture of FIG. 3.
Figure 4B:
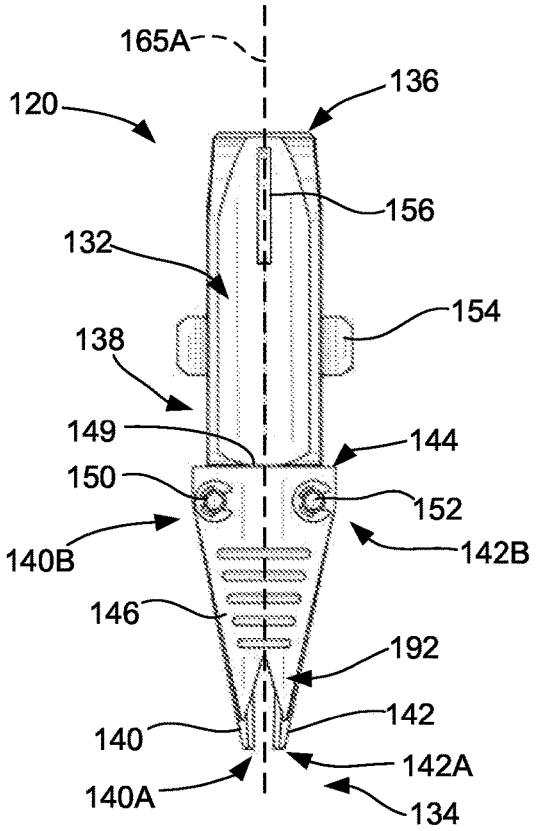

FIG. 3 is an isometric depiction of the blade fixture 120 of FIGS. 2A-2C in some embodiments. FIGS. 4A and 4B show top and side plan views of the blade fixture 120 from FIG. 3.

The blade fixture 120 includes a main body 132 with opposing proximal end 134 and distal end 136. Housed within the main body 132 is a retraction mechanism 138, details of which will be described more fully below.

A pair of opposing clamping jaws 140, 142 are disposed at the proximal end 134 of the blade fixture. The clamping jaws 140, 142 are sometimes referred to as a first clamping jaw and a second clamping jaw, as well as an upper jaw and a lower jaw. The jaws 140, 142 are arranged to compressingly engage opposing sides of the blade of the cutting tool (e.g., sides 16, 18 in FIG. 1B) during a sharpening operation. The jaws 140, 142 are hingedly mounted to a support assembly 144 affixed to the main body 132.

The support assembly 144 is substantially u-shaped and includes opposing first and second support plates 146, 148 which project from a transversely extending base plate 149. The support plates 146, 148 are stationary in nature and are arranged to extend along and in adjacent relation to respective sides of the jaws 140, 142 as shown.

Each of the jaws 140, 142 have a proximal end (or clamping end) 140A, 142A and a distal end (or a hinged end) 140B, 142B. The respective clamping ends 140A, 142A are configured to compressingly engage the sides of the blade to be sharpened. The respective distal ends 140B, 142B are configured to rotate relative to the support plates 146, 148 via shafts 150, 152. The shafts 150, 152 extend through the distal ends 140B, 142B of the jaws 140, 142 and into the respective stationary first and second support plates 146, 148. This arrangement allows the distal ends 140B, 142B to rotate about the shafts 150, 152. Other hinged arrangements can be used as desired so this hinged arrangement of FIG. 4A is illustrative and is not limiting.

The retraction mechanism 138 includes a knob 154, which is user activated to selectively increase and decrease the amount of compressive clamping force exerted by the clamping ends 140A, 142A of the clamping jaws 140, 142. Side rails 156, 158 (best viewed in FIG. 4A) aid in the alignment and securement of the blade fixture 120 into the base assembly 110. The central fixture plane 165A is respectively shown in FIGS. 4A and 4B.

Figure 5:
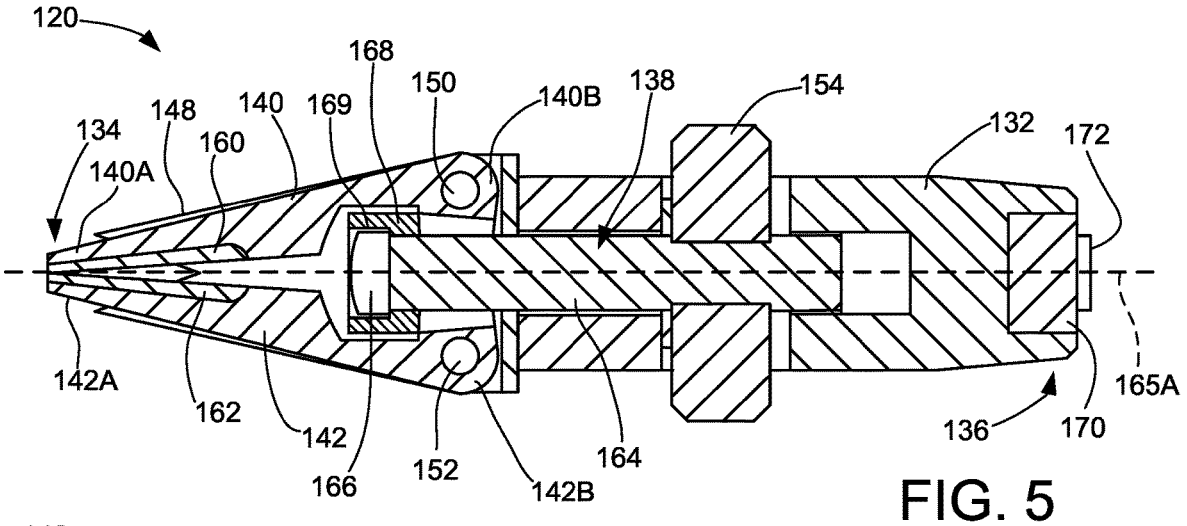
FIG. 5 is a cross-sectional representation of the blade fixture.

FIG. 5 provides a cross-sectional depiction of the blade fixture 120 to show further details of interest. Each of the jaws 140, 142 optionally includes a recessed layer of non-marring, elastomeric material; a first such layer 160 is incorporated into the upper jaw 140 and a second such layer 162 is incorporated into the lower jaw 142. The layers 160, 162 can be any suitable material, such as but not limited to neoprene. The material that forms the layers 160, 162 is sufficiently rigid to secure the blade while at the same time compliant enough to not scratch, mar or otherwise deform the finish of the blade. While compliant materials are shown, such are not necessarily required; other embodiments do not utilize such materials and instead use the jaws, or other features thereof, to directly engage and clamp the cutting tool.

The retraction mechanism 138 from FIGS. 3, 4A and 4B is shown in FIG. 5 to include a threaded shaft 164 embedded within the main body 132 of the blade fixture 120. The knob 154 is adapted to engage the threads of the shaft 164 in order to advance and retract the shaft 164 along a central axis that nominally lies along the aforedescribed central fixture plane 165A.

A retention member 166 is affixed to a proximal end of the shaft 164 adjacent and between the jaws 140, 142. The retention member 166 is substantially rectangular in shape, and may have a curved facing surface as shown. The retention member 166 is fixed to the proximal end of the shaft 164.

The retention member 166 is configured to be retracted into a pressure block 168. A recessed slot 169 is formed in the pressure block 168 for this purpose; that is, the recessed slot 169 is sized to receive and nest the retraction member 166. As the shaft 164 is retracted through user rotation of the knob 154, the member 166 retracts (via insertion into the slot 169) the block 168, thereby causing the jaws 140, 142 to rotate about the respective shafts 150, 152 and increase clamping force therebetween. Other retraction mechanisms can be used.

Further features of the blade fixture 120 in FIG. 5 include a reinforced base insert 170 and a magnet 172 affixed to the distal end 136 of the main body 132.

Figure 6A:
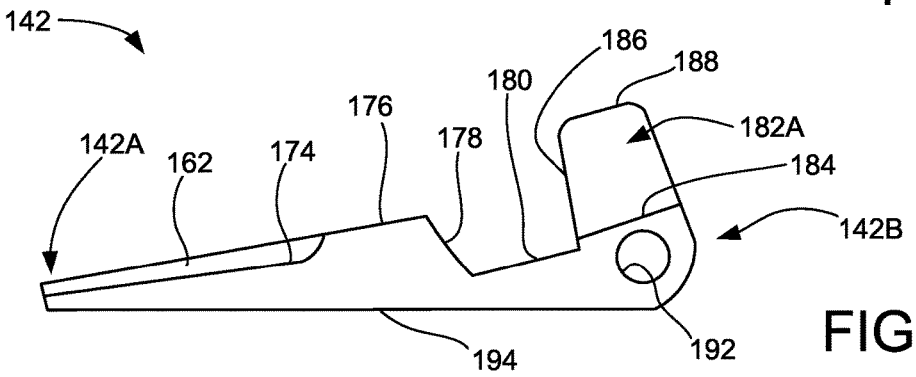
FIGS. 6A and 6B show side and top plan views of a clamping jaw of the blade fixture.
Figure 6B:
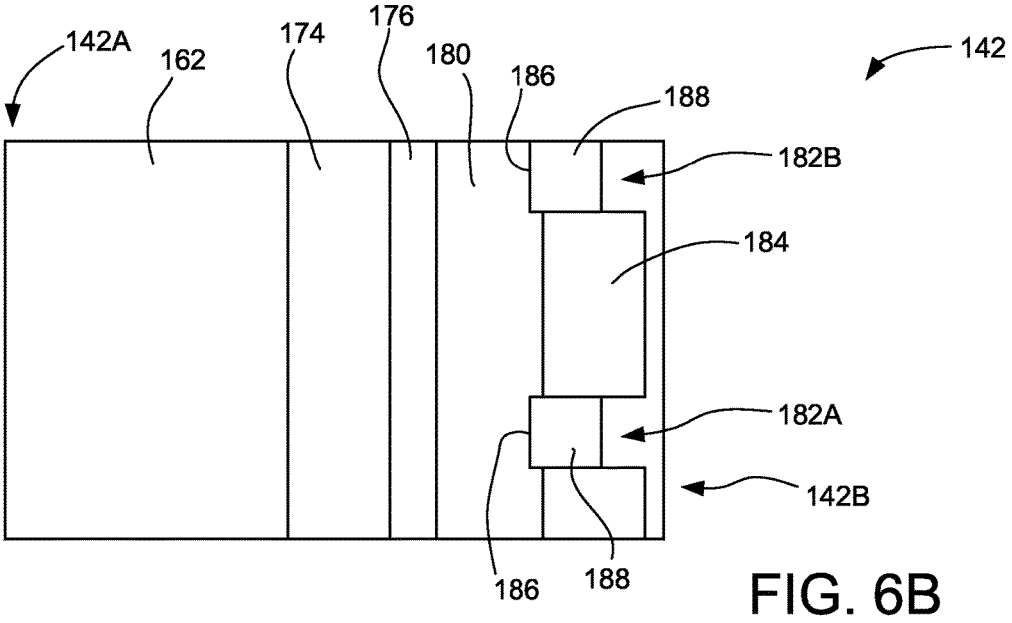

FIG. 6A shows a side elevational view of the lower jaw 142 in accordance with some embodiments. FIG. 6B is a corresponding top plan view of the lower jaw 142 of FIG. 6A. It will be understood that the features depicted on the lower jaw 142 are also present on the upper jaw 140, although the upper jaw 140 is rotated 180 degrees with respect to the lower jaw 142 so as to be in facing relation thereto. In this way, the respective jaws 140, 142 are nominally identical and arranged in mirrored fashion to enhance manufacturability. This is not necessarily required, however, as the respective jaws can have different configurations.

Continuing with FIG. 6A, the compliant layer 162 (e.g., layer of neoprene, etc.) is housed within a recess 174 of an interior clamping surface 176. A recessed surface 178 extends downwardly from the surface 176, to provide clearance for the operation of the retraction member 166 and pressure block 168 (FIG. 5). A shoulder surface 184 extends from the recessed surface 180 to further provide the above noted clearance.

A pair of spaced apart projections 182A, 182B extend upwardly at a desired angle from a platform portion 184 adjoining the shoulder surface 180. Each of the respective projections 182A, 182B has a pressure surface 186 and a top surface 188.

Figure 7A:
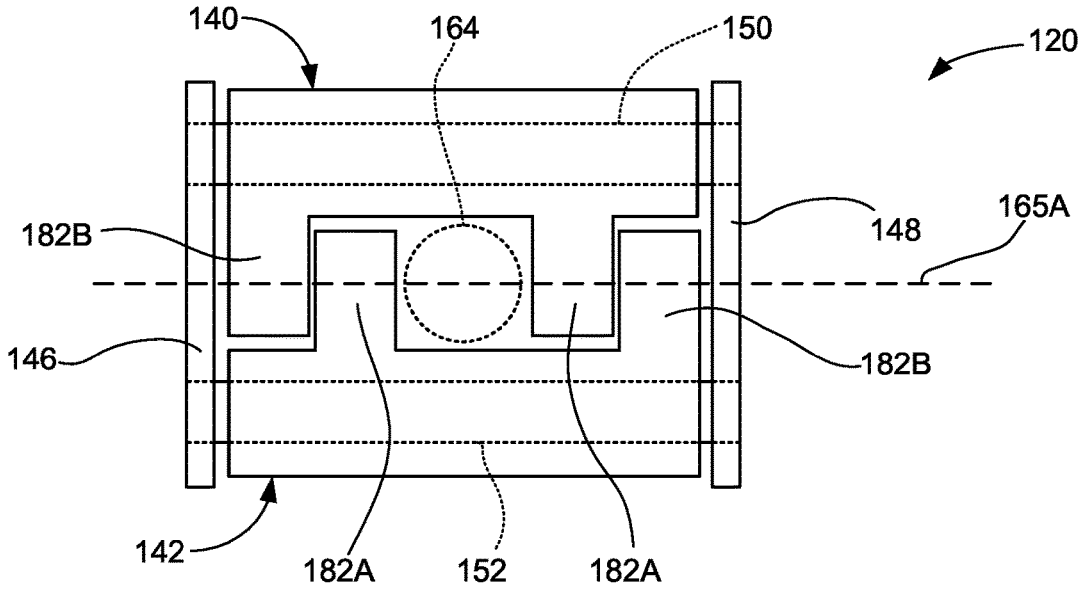
FIGS. 7A and 7B show interaction of the respective top and bottom clamping jaws of the blade fixture in some embodiments.
Figure 7B:
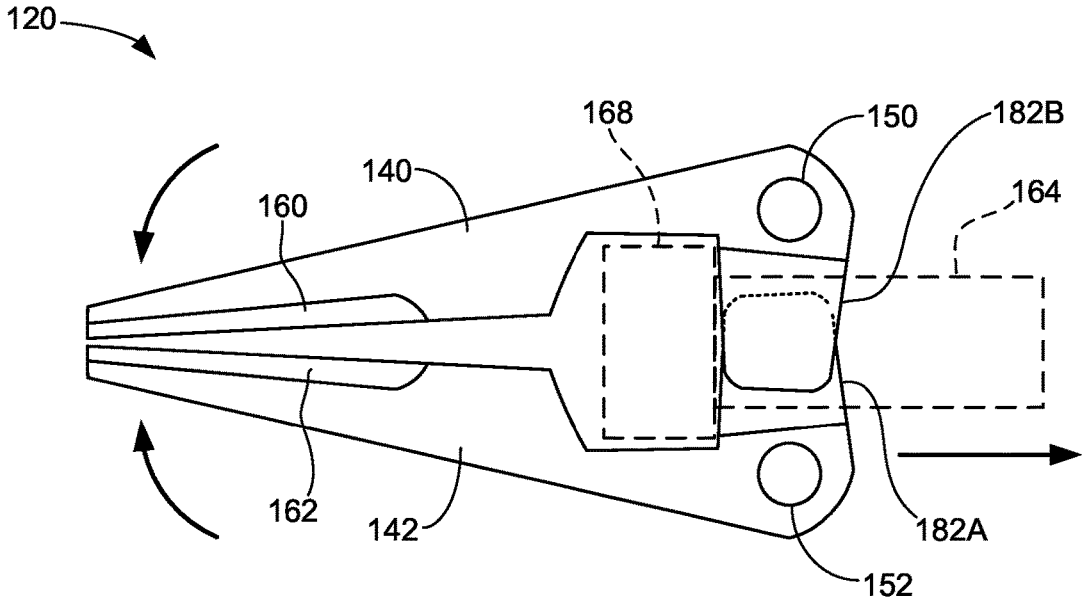

FIGS. 7A and 7B show the interlocking orientation of the projections 182A, 182B on both the upper jaw 140 and the lower jaw 142. A pair of the projections is arranged on each side of the central shaft 164. The pressure block 168 (see FIG. 5) bears against the pressure surfaces 186 of the respective projections as the shaft 164 is retracted to induce rotation of the jaws 140, 142 about the respective shafts 150, 152, thereby applying a desired clamping force upon the opposing sides of the blade (FIG. 1B).

Figure 8A:
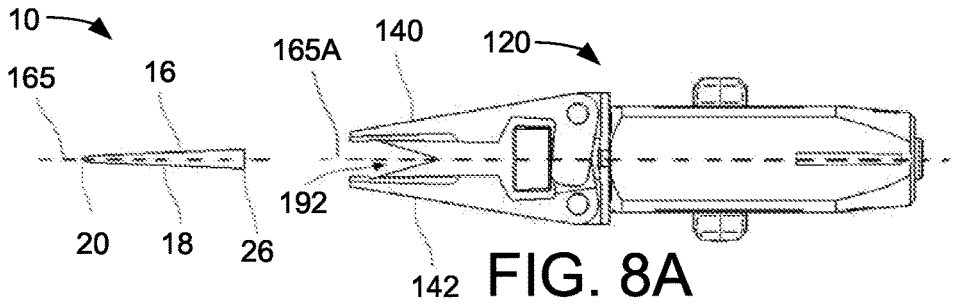
FIGS. 8A through 8C show additional details regarding the blade fixture in some embodiments.
Figure 8B:
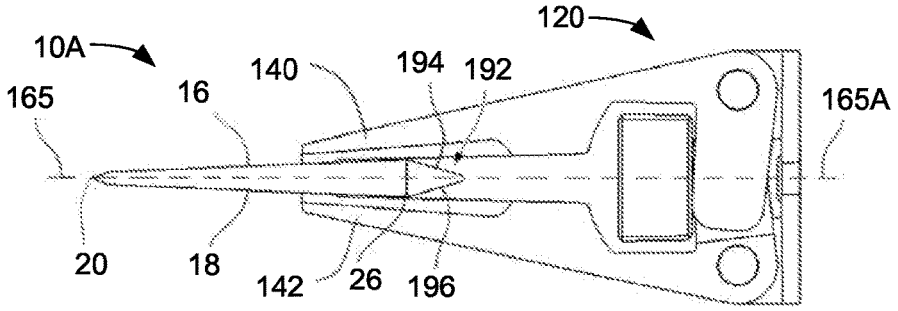
Figure 8C:
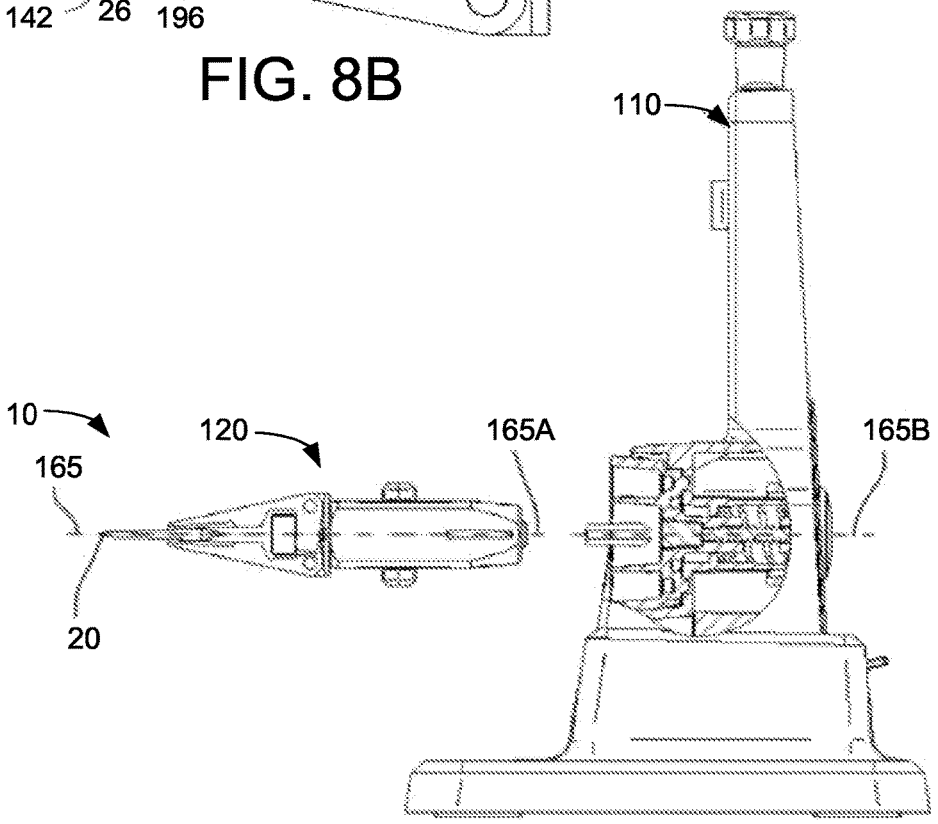

FIGS. 8A through 8C show further details regarding the blade fixture 120. FIG. 8A shows the presentation of the cutting tool 10 from FIGS. 1A-1B into alignment guides 192 of the blade fixture 120. FIG. 8B is an expanded view of FIG. 8A and shows mating arrangement of the cutting tool 10 such that the spine 26 of the cutting tool 10 is brought into contact with guides 192. The centering and limit stop characteristics of the guides 192, defined by surfaces 194, 196, provide nominal centering and insertion depth limit operations upon the spine 26, thereby centering the blade 10 within the blade fixture 120 and aligning the central blade plane 165 with the central fixture plane 165A.

As further shown in FIG. 8C, insertion features further align planes 165, 165A and 165B in a controlled and repeatable fashion, even if the blade fixture 120 and blade 10 are removed and replaced into the base assembly 110. The guides 192 are characterized as v-shaped notches and are provided on each side of the clamping jaws 140, 142 at a medial location between the proximal and distal ends 140A/140B and 142A/142B thereof, as provided by the respective side plates 146, 148.

The various components forming the blade fixture 120 can be constructed of any number of suitable materials. Without limitation, in some embodiments the clamping jaws 140, 142 are formed of metal (such as steel), the main body 132 is formed of injection molded plastic, and the support assembly 144 (including opposing support plates 146, 148) is formed of metal or plastic. Other configurations can be used, however, including an arrangement wherein the support assembly is integrated into the main body 132 as a single piece construction, all pieces are formed of metal, all pieces are formed of plastic, some or all pieces are formed of different materials, etc. As noted above, removable and/or adjustable side plates can be provided to accommodate different lengths, thicknesses and widths of cutting tools within the same blade fixture. A shorter or longer blade fixture can be used; other clamping and securement mechanisms can be used; and so on.

Reference is now made to FIG. 9, which provides an isometric depiction of the abrasive assembly 130 of FIGS. 2A-2C. The abrasive assembly 130 generally comprises an abrasive block 200 (also sometimes referred to as a sharpening block or an abrasive block assembly). The abrasive block 200 is affixed for sliding movement along a moveable rod 202.

Limit stops, such as in the form of elastomeric rings 204, 206, can be placed in suitable locations along the rod 202 to define a desired range of axial motion of the abrasive block 200 along the rod 202. The rings 204, 206 provide a compression fit against the outer surface of the rod 202 and can be slidingly moved as desired by the user for a given sharpening application.

Different configurations can be used for the rings 204, 206 as desired. FIG. 9A shows a first ring 204 with a circular cross-sectional shape. FIG. 9B shows a second ring 204A with a rectilinear (e.g., square) cross-sectional shape. Other configurations can be used as desired, including rings with inner or outer rectilinear shapes, etc.

An engagement mechanism 208 is disposed at a distal end of the rod 202 as shown. The engagement mechanism 208 has ball and socket configuration to facilitate mating engagement of the rod 202 with the base assembly 110.

FIGS. 10A through 10C show additional views of the abrasive assembly 130. The abrasive block 200 includes a generally u-shaped frame (housing) 210 and an abrasive cartridge 212 supported within the frame 210. The frame 210 has a longitudinally extending base portion 214 that extends along the extent of the abrasive block 200 and has respective proximal and distal ends 216, 218, each characterized as downwardly depending flanges configured to intersect and allow passage of the rod 202 therethrough.

The embodiment of FIGS. 10A through 10C includes a centrally disposed handle 220 that extends upwardly from the longitudinally extending base portion 214 of the frame 210. The handle 220 provides a user graspable surface to enable the user to safely manipulate the abrasive block 200 during a sharpening operation as the user advances the abrasive block along the exposed cutting edge of the tool.

In the embodiment of FIGS. 9 and 10A-10C, the abrasive cartridge 212 includes a total of three (3) abrasive members 222, 224 and 226. These members are arranged in a substantially triangular orientation, so that each member has an associated abrasive surface that extends at an angle of nominally 60 degrees with respect to each of the other remaining abrasive surfaces, as measured along a rod axis 228 along the rod 202 (see FIG. 9). The rod axis 228 is a central axis that corresponds to rod axis 122 in FIG. 2B, for reference.

It is contemplated that each of the abrasive members 222, 224, and 226 will have different abrasiveness levels, or grits, to enhance the sharpening operation. Without limitation, in one embodiment the first abrasive member 222 is a diamond coated metal member with an abrasiveness level of 320 grit, the second abrasive member 224 is a diamond coated metal member with an abrasiveness level of 600 grit, and the third abrasive member 226 is a ceramic member with an abrasive level of 1200 grit. Other material compositions and grit levels can be used as desired, so these are merely for purposes of illustration and are not limiting.

As described more fully below, a sequential sharpening operation can be carried out in which the first, most aggressive abrasive surface is used for a coarse sharpening operation; the second, less aggressive abrasive surface is used for a fine sharpening operation; and the third, least aggressive abrasive surface is used for a honing operation. Not all three surfaces need be used during every sharpening operation.

Figure 11A:
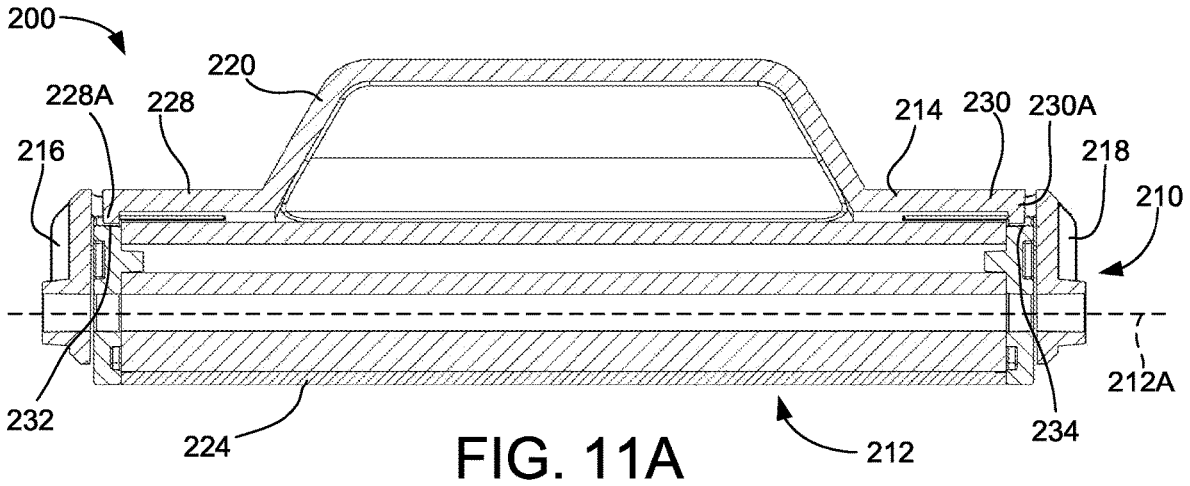
FIGS. 11A through 11C show further details of the abrasive assembly.
Figure 11B:
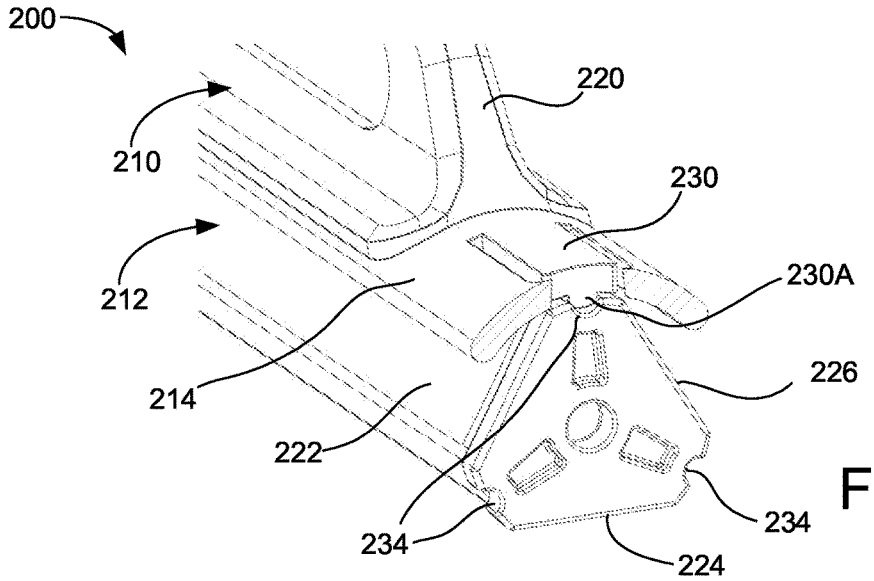
Figure 11C:
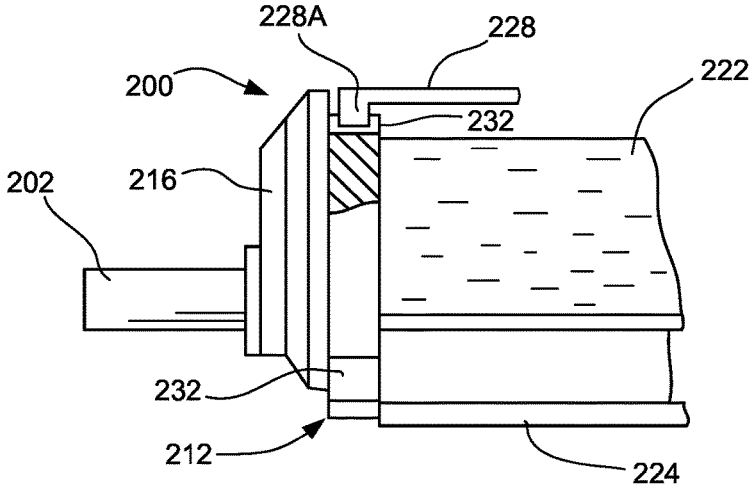

FIGS. 11A through 11C show further details regarding the abrasive block 200 in some embodiments. FIG. 11A is a cross-sectional representation of the abrasive block 200. FIG. 11B is a partial cross-sectional end isometric view to illustrate the locking interaction between the frame 210 and the cartridge 212. FIG. 11C is a schematic diagram to further illustrate this interaction between the frame 210 and the cartridge 212.

As noted above, a particular feature of the block 200 is the ability to present different abrasive surfaces for sharpening against the blade secured by the blade fixture 120. To this end, a pair of retention assemblies are provisioned at each end of the base portion 214 of the frame 210. Each retention assembly comprises a spring biased arm 228, 230 that recesses into a corresponding slot (groove) 232, 234 of the cartridge 212. This allows the user to rotate the cartridge 212 within the frame 210 about a cartridge axis 212A to present the desired abrasive surface of the respective abrasive members 222, 224, 226. The arms 228, 230 allow rotation of the cartridge, and serve to lock into place the desired facing abrasive surface through engagement of the respective arms 228, 230 into the grooves 232, 234.

Each spring biased arm 228, 230 has a locking flange (deflectable finger) 228A, 230A that nests into the corresponding groove 232, 234. The spring bias force provided is sufficient to lock the cartridge 212 in a desired configuration so that the selected abrasive surface is facing away from the handle 220 and allows the abrasive to remain fixed relative to the axis 228 during the sharpening operation. At the same time, the spring bias force is compliant enough to allow the user to overcome this force and rotate the cartridge 212 within the frame 210 to select the next desired abrasive surface. In an alternative embodiment, a non-rotatable abrasive cartridge configuration can be used so that, for example, the user removes and reinstalls the cartridge to select the desired abrasive surface for use.

In other embodiments, the abrasive block 200 may be affixed to the rod 202. The engagement mechanism 208 is then configured for sliding engagement to rod 202 wherein the abrasive block 200 and rod 202 move together with respect to the engagement mechanism 208.

In further embodiments, the frame 210 of block 200 is rigidly affixed to the rod 202 by respective proximal and distal ends 216, 218. The user handle 220 is affixed to the proximal end 216. The handle 220, proximal and distal ends 216, 218, and the rod are rigidly affixed together forming an inline shaped frame 210. It is noted in this case that the longitudinally extending base portion 214 is not needed.

Figure 12A:
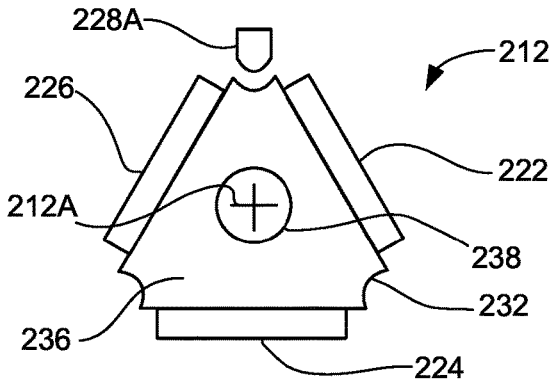
FIGS. 12A through 12D show different numbers and types of selectable abrasive surfaces that can be presented by the abrasive assembly in alternative embodiments.

FIG. 12A is a simplified schematic end depiction of the cartridge 212 from FIGS. 9 through 11C. As noted previously, a total of three (3) abrasive members are provided (members 222, 224 and 226). Grooves 232 are supplied in the corners of the substantially triangular arrangement to receive the respective locking features 228A (and 230A, discussed above). A main body for the cartridge is denoted at 236, and a central aperture 238 is provided through the main body 236 to accommodate the rod 202. The abrasive members can take any number of forms, including conformable members.

Figure 12B:
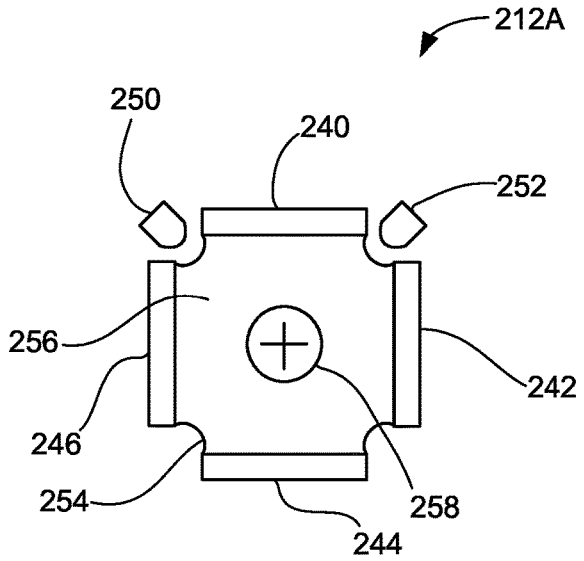

Other respective numbers of abrasive members can be incorporated into the abrasive block 200 as desired. FIG. 12B shows an alternative cartridge 212A, which has a total of four (4) abrasive members 240, 242, 244 and 246. In this case, one or more locking tabs (fingers), such as indicated at 250, 252, can be provided to recess into corresponding grooves 254. As before, the four abrasive members can be individually selected by the user as desired to impart different sharpening operations upon an associated cutting tool. It will be appreciated that the selected abrasive member will be rotated to the selected facing orientation. The cartridge 212A has a main body 256 with central aperture 258 to accommodate the rod 202.

Figure 12C:
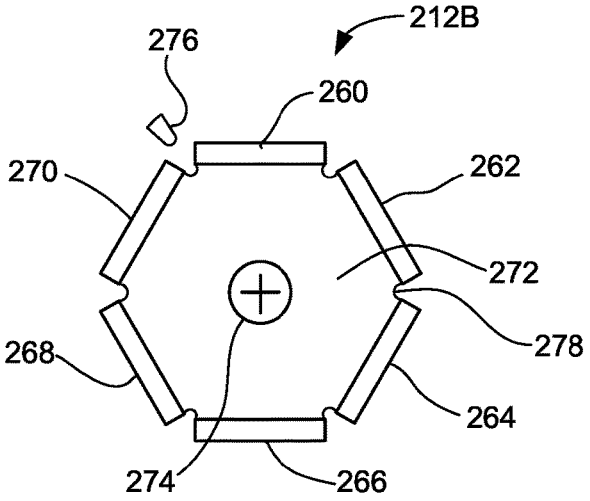
Figure 12D:
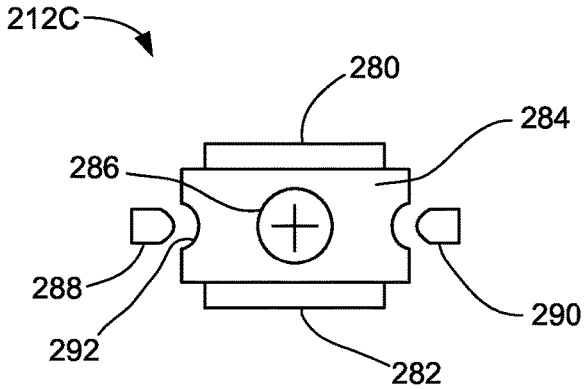

FIG. 12C shows another cartridge assembly 212B with a total of six (6) abrasive members 260, 262, 264, 266, 268, 270, supported by a main body 272 with central aperture 274. One or more locking tabs 276 are provisioned to lock the selected abrasive member into respective grooves 278 for presentation in the desired facing orientation against the cutting edge of the tool being sharpened. FIG. 12D shows yet another cartridge assembly 212C with a total of two (2) abrasive members 280, 282, mounted to main body 284 with aperture 286. Locking tabs (fingers) 288, 290 engage various grooves 292 as described above.

The various abrasive members may have different constructions (e.g., ceramic, diamond coated, replaceable media, lapping film, abrasive rods, leather, etc.) that provide different material removal rates and grits. However, it is contemplated that the same or similar abrasiveness levels may be provided on multiple sets of the abrasive members to enhance wear and other efficiencies. In some cases, an abrasive surface may be supported by a compliant layer, such as a layer of open or closed cell foam, rubber, etc., to provide compliance to the sharpening operation.

Figure 13:
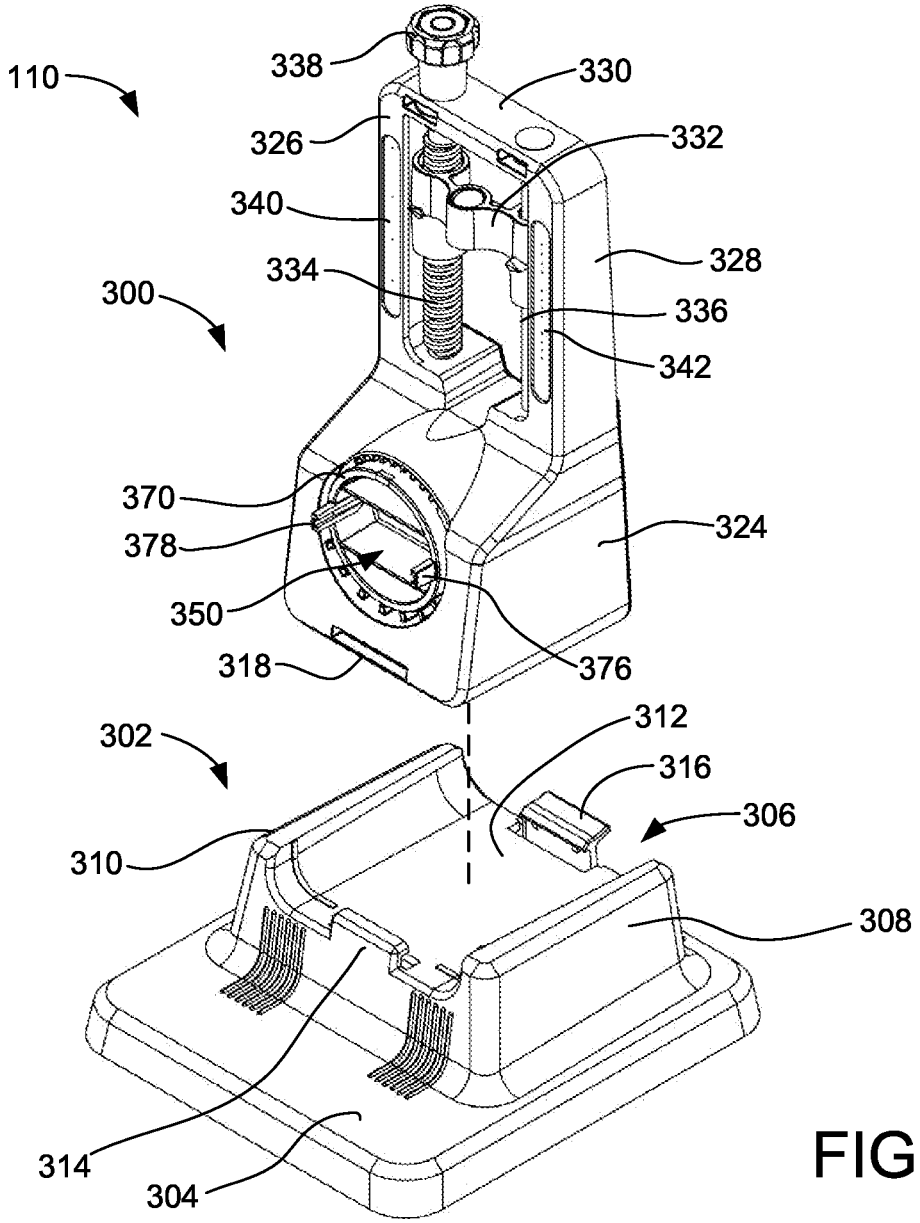
FIG. 13 is an exploded, isometric depiction of a base assembly of the sharpener of FIGS. 2A-2C in accordance with some embodiments.
Figure 14A:
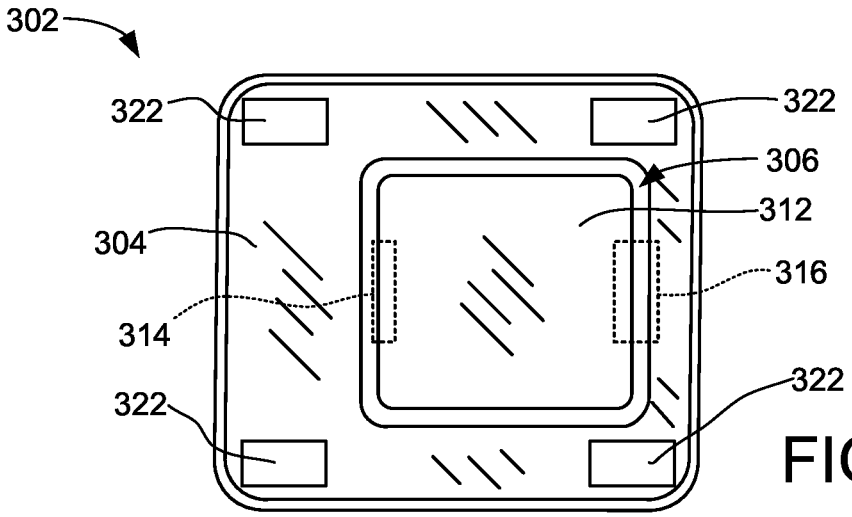
FIG. 14A is a bottom view of the base assembly.
Figure 14B:
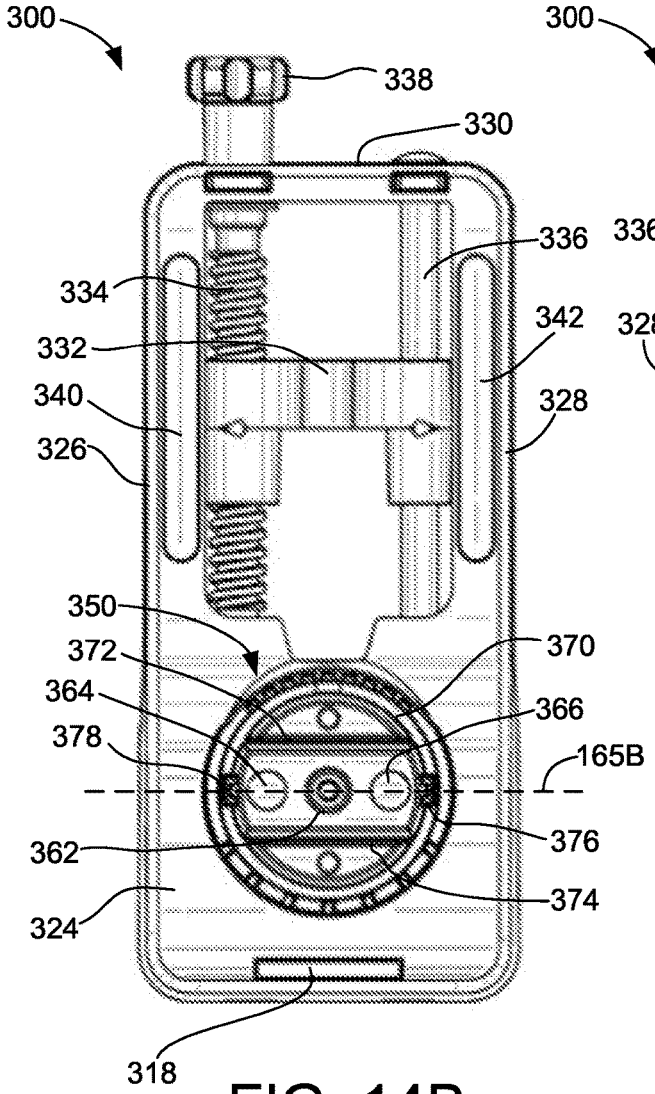
FIGS. 14B and 14C show respective front and rear end views of the base assembly.
Figure 14C:
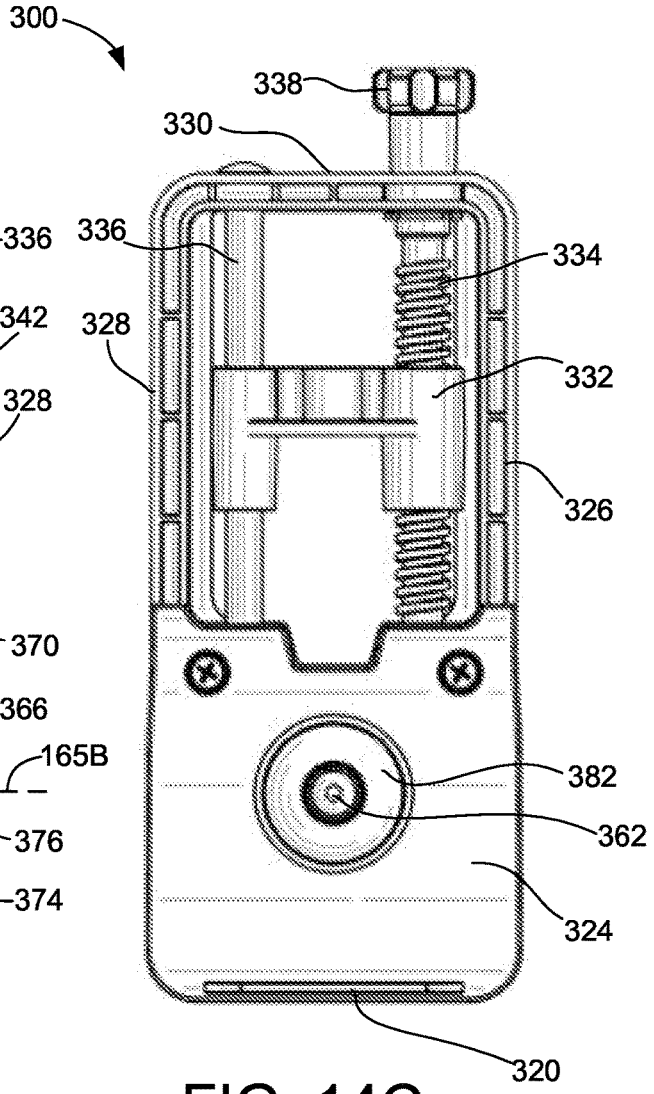

FIG. 13 shows an exploded, isometric depiction of the base assembly 110 from FIGS. 2A-2C. The base assembly 110 includes a tower assembly 300 which is configured to be matingly engageable with a base pedestal 302. Other configurations can be used, so the arrangement of the base assembly 110 in FIG. 13 is merely illustrative and is not limiting, including but not limited to a unitary base assembly construction. FIG. 14A shows a bottom plan view of the pedestal 302. FIGS. 14B and 14C show front and rear illustrations of the tower assembly 300.

The base pedestal 302 includes a rectilinear base 304 with a relatively large surface area to provide stability and support for the sharpener 100 on a base surface (e.g., surface 111 in FIG. 2B). A raised platform 306 extends from the base 304 having side walls 308, 310, base support surface 312, and deflectable front and rear locking tabs 314, 316. The tower assembly 300 includes front and rear receiving apertures 318, 320 (see FIGS. 14B, 14C) to receive the respective locking tabs 314, 316 to secure mating engagement of the tower 300 to the base pedestal 302 upon base support surface 312.

FIG. 14A shows pads 322 arranged as non-skid, high friction support elements along the bottom surface of the base 302. The pads 322 are arranged to contactingly engage the underlying base support surface (111, FIG. 2B) to provide stability during the sharpening operation based on the frictional interaction between the pads 322 and the underlying surface.

It will be noted that the frictional contact between the pads 322 and the underlying surface 111 can be selected to be sufficient to provide stability during the sharpening operation. At the same time, should the user fall or otherwise bump up against the exposed cutting surface of the blade clamped by the system, the system will be deflected along (scoot) against the underlying base support surface 111 to prevent cutting damage being imparted to the user.

It will be appreciated that any sharpening operation involves inherent risks, but the ability of the system to be shifted along the underlying surface 111 can reduce such risks to injury to the user during the sharpening operation, and therefore may be utilized in some embodiments. In other configurations, the risk of exposure to the exposed cutting edge may be ameliorated in other ways (including but not limited to shields, robotic actuation, etc.), and therefore in other cases it may be acceptable to clamp or otherwise affix the base assembly 110 to the underlying surface 111.

Continuing with FIG. 13, the tower 300 includes a base portion 324, a pair of opposing vertical support rails 326, 328 which extend from the base portion 324, and a horizontal support rail 330 which adjoins the vertical support rails 326, 328. The respective rails 326, 328 and 330 provide an open framework to facilitate operation of an adjustment mechanism 332 therein. The adjustment mechanism 332 is advanced and retracted in a vertical direction along a threaded shaft 334 and a cylindrical support shaft 336 responsive to user activation of a knob (screw mechanism) 338. The separate support shaft is merely illustrative for purposes of stability but is not necessarily required. Printed indicia regarding the relative elevation, and hence the imparted angle of the sharpening operation applied to the clamped blade by the abrasive assembly 130, is provided via indication panels 340, 342 that are arranged along the respective vertical support rails 326, 328. It will be appreciated that other arrangements can be utilized for the adjustment mechanism so that the arrangement shown is merely illustrative and is not limiting.

FIG. 13 further shows a receiving slot 350 in the base portion 324 of the tower 300 of the base assembly 110. The receiving slot 350 is adapted to receive the distal end 136 of the blade fixture 120, as discussed above in FIGS. 4A and 4B.

Figure 15:
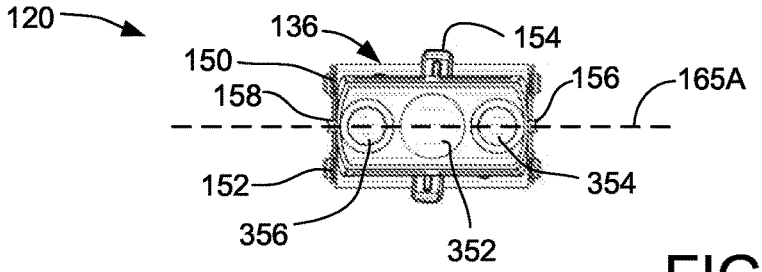
FIG. 15 is an end view of the blade fixture of FIG. 3 to illustrate mating insertion thereof into a receiving slot of the base assembly in FIG. 14B.

As shown more fully in FIGS. 14B and 15, the distal end 136 of the blade fixture 120 includes a number (in this case, three, 3) magnetic elements that are configured for magnetic interaction with a corresponding number (again, three, 3) elements within the receiving slot 350. As used herein, the term "magnetic element" will be understood as either a source of magnetic flux (as in the case of a magnet) or a magnetically permeable material, such as a ferromagnetic layer (e.g., a steel plate or other material with ferroelectric attractive properties, such as iron, etc.).

More particularly, without limitation the distal end 136 of the blade fixture 120 has a central magnet 352 and opposing ferroelectric plates 354, 356 on each side of the central magnet 352. Correspondingly, the receiving slot 350 has a central ferromagnetic member 362, characterized as a plunge pin as described below, and which is adapted to be magnetically coupled to the central magnet 352 of the blade fixture. For reference, the central magnet 352 corresponds to the magnet 172 discussed above in FIG. 5.

The receiving slot 350 further has opposing magnets 364, 366 which are adapted to magnetically engage the ferroelectric plates 354, 356 of the blade fixture 120. Other arrangements can be used so that this particular configuration is merely for purposes of illustration and is not limiting. Alternative configurations can include different respective numbers of magnetic elements, as well as other coupling mechanisms that do not utilize magnetic force to provide the required interlocking actions described herein.

Continuing with a review of FIG. 14B, it can be seen that the receiving slot 350 includes a recessed cup, or cylindrical recess member 370. The cup 370 is housed within the base assembly portion 324 of the tower assembly 300, and supports the aforementioned magnetic elements 362, 364 and 366. The cup 370 includes first and second (upper and lower) guide flanges 372, 374. The flanges 372, 374 are arranged to allow sliding engagement of the distal end 136 of the blade fixture 120 therebetween in close alignment therewith. The cup further includes projecting guides 376, 378. These projecting guides 376, 378 are configured to receive sliding engagement from the side rails 156, 158 on the sides of the blade fixture 120.

It will be noted at this point that the magnetic coupling of the respective magnetic elements 352, 354, 356 of the blade fixture 120 and the magnetic elements 362, 364, 366 of the receiving slot 350, as well as the mechanical interaction between the guide flanges 372, 374 and the upper and lower sides of the main body 132 of the blade fixture 120, and the mechanical interaction of the side rails 156, 158 with the projecting guides 376, 378, will induce a fixed mechanical orientation of the blade fixture 120, and hence the blade clamped thereby, within the receiving slot 350 of the base assembly 110.

Stated another way, the inserted blade fixture 120, once received into the receiving slot 350, is mechanically coupled thereto and is maintained in a fixed angular and translational position with respect to the base assembly 110 via the cup 370. This will nominally align plane 165B of the base assembly 110 with the central plane 165A of the clamp assembly 120. This is important because the cup 370 provides precise orientation and rotation of the blade fixture 120, which can be enacted through depression of a spring biased plunger 382 opposite the cup 370 (see FIG. 14C).

Figure 16A:
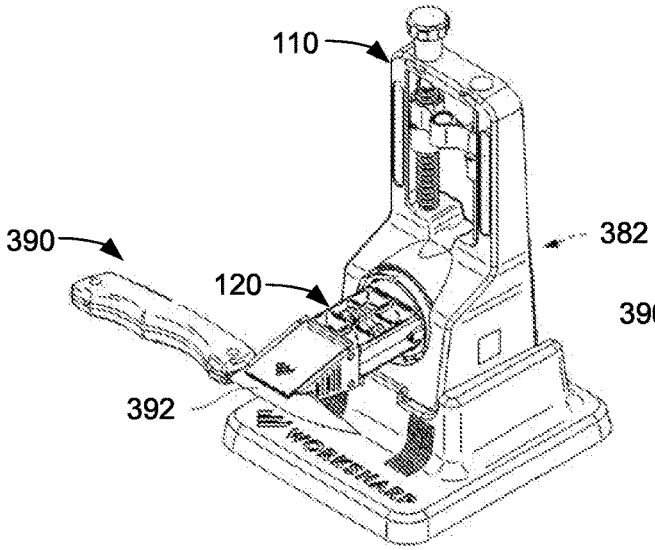
FIGS. 16A through 16C illustrate interaction of the blade fixture and the base assembly in conjunction with a sharpening operation upon a cutting tool.
Figure 16B:
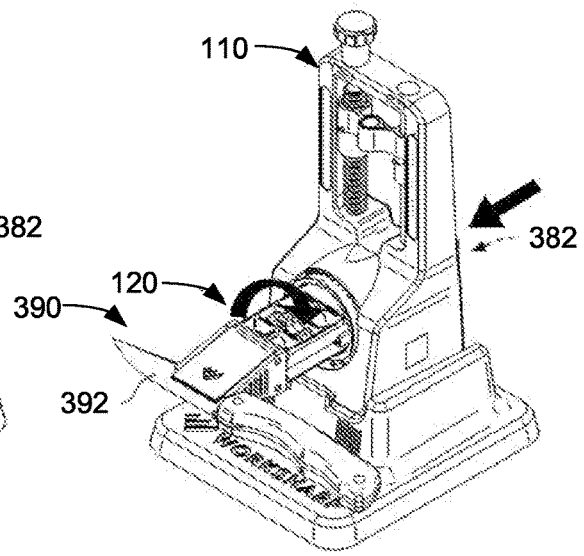
Figure 16C:
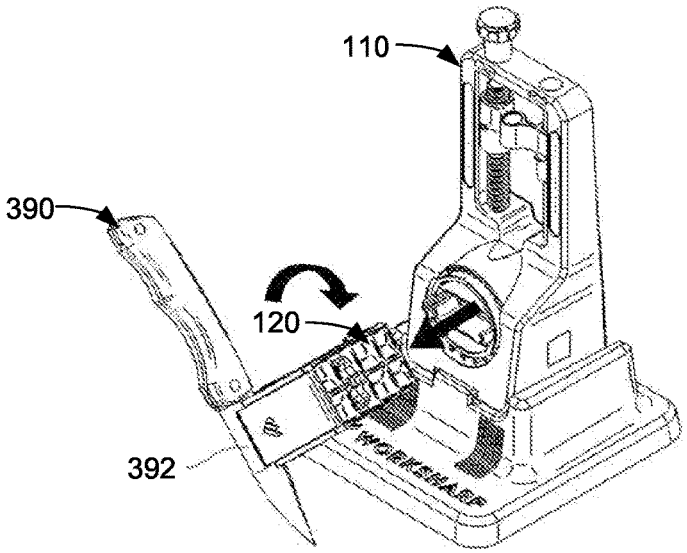

FIGS. 16A through 16C provide isometric depictions of a cutting tool sharpening operation upon a cutting tool 390 having a blade portion 392. Once clamped, the cutting tool 390 can be sharpened on a first side (FIG. 16A), and rotated within the base assembly by 180 degrees to facilitate sharpening of an opposing second side (FIG. 16B). The spring biased plunger 382 (FIG. 14C) is biased via an internal coiled spring (not separately shown). By depressing the plunger 382, the cup 370 (FIG. 14B) can be advanced and rotated 180 degrees, as controlled by internal locking tabs.

In this way, the user can depress the plunger 382 and rotate the tool 390 between the position in FIG. 16A and the position in FIG. 16B. Additional spring biased and locking mechanisms can be incorporated as desired, but are not shown for purposes of clarity. Alternatively, the user can remove the cutting tool and blade fixture combination, rotate the same 180 degrees, and then reinsert the combination back into the base assembly as depicted in FIG. 16C.

Figure 17A:
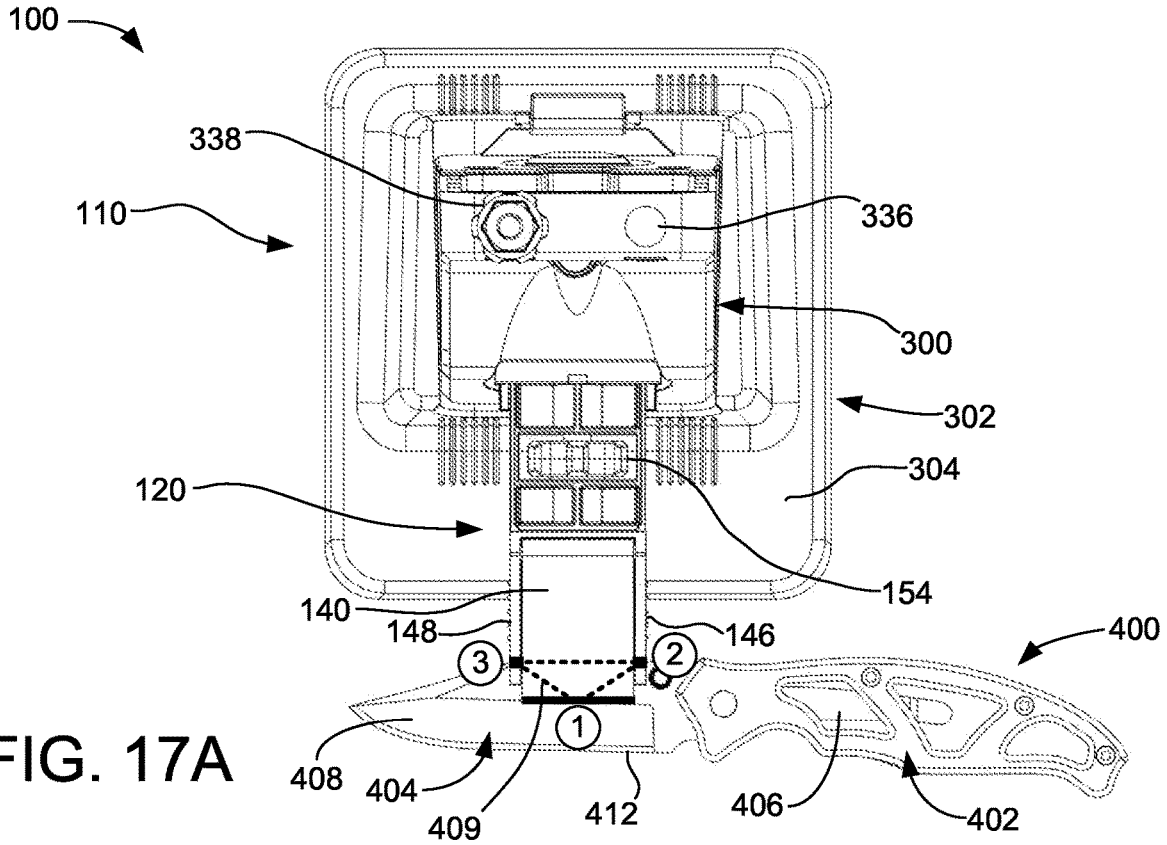
FIGS. 17A and 17B show respective top plan views of sharpening orientations upon a cutting tool by the sharpener.
Figure 17B:
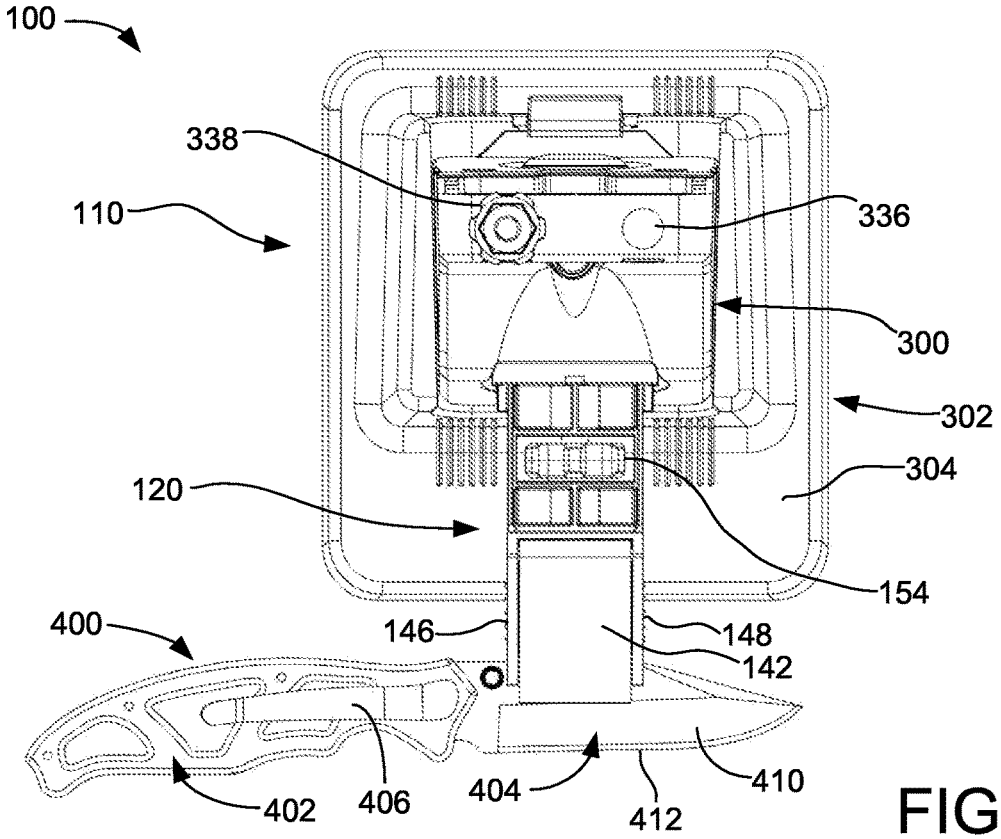

FIGS. 17A and 17B show top plan views of the base assembly 110 and the blade fixture 120 with another cutting tool 400. The cutting tool 400 is characterized as a foldable pocket knife, with handle 402 and blade 404. The blade 404 can be rotated into an extended position as shown, or can be retracted within the handle 402 in a folded position. A pocket clip 406 is affixed to the handle 402 to enable convenient placement of the folded pocket knife in a user's pocket.

The blade 404 includes opposing sides 408, 410 which converge to a cutting edge 412 which is sharpened using the abrasive assembly 130 (see FIG. 2C). Side 408 is sharpened in the configuration of FIG. 17A, and side 410 is sharpened in the configuration of FIG. 17B. Depression of the plunger 382 (FIG. 14C) enables the user to rotate the knife 400 between the respective orientations of FIGS. 17A and 17B during a sharpening sequence, as described above. Alternatively, the user can remove the combination of the blade fixture 120 and the knife 400, rotate the same in free space, and reinsert both into the base assembly 110, as depicted above in FIG. 16C.

An aspect of the sharpener is a spaced apart multi-point contact arrangement provided by the blade fixture 120. This contact arrangement is denoted generally by broken-line triangle 409 and blackened contact areas in FIG. 17A. Contact points are generally denoted at "1", "2" and "3". The contact points are generally along the proximal end of the clamping jaws 140, 142, and each of the respective alignment guides 192 on each side of the clamping jaws. It will be noted that these contact points are located between the respective proximal and distal ends of the jaws. This stabilizes and centers the blade within the blade fixture 120.

In the configuration of FIG. 17A, it will be noted that contact is provided along the entirety of the lengths of the respective jaws 140, 142 (e.g., contact area "1") via the embedded compliant material 160, 162 (see FIG. 5), so reference to multi-point contact, or triangular contact, is not necessarily limited to equally sized contact areas. It will be noted, for example, that a four (or more) point contact area could be easily established by segmenting the compliant material 160, 162 (or other contact features) into discrete segments that individually contact the blade, and the same result would be obtained. Nevertheless, those having skill in the art will recognize that multiple spaced apart points (or areas) of contact are usually required to establish a plane, and therefore the three-point contact arrangement provided by the blade fixture 120 does this.

Technically speaking, there are six points of contact (three on each side of the blade) by the blade fixture in FIG. 17A, counting the opposing contacts provided by each of the upper and lower jaws and the centering guides, in order to hold the blade in the desired orientation. Additional or fewer points of contact are clearly contemplated and included within the scope of the present disclosure, and so the term multi-point contact will be understood to cover at least two spaced apart points on contact on at least side of the blade, and additional points are in no way limited to the embodiments illustrated in the drawings.

Figure 18A:
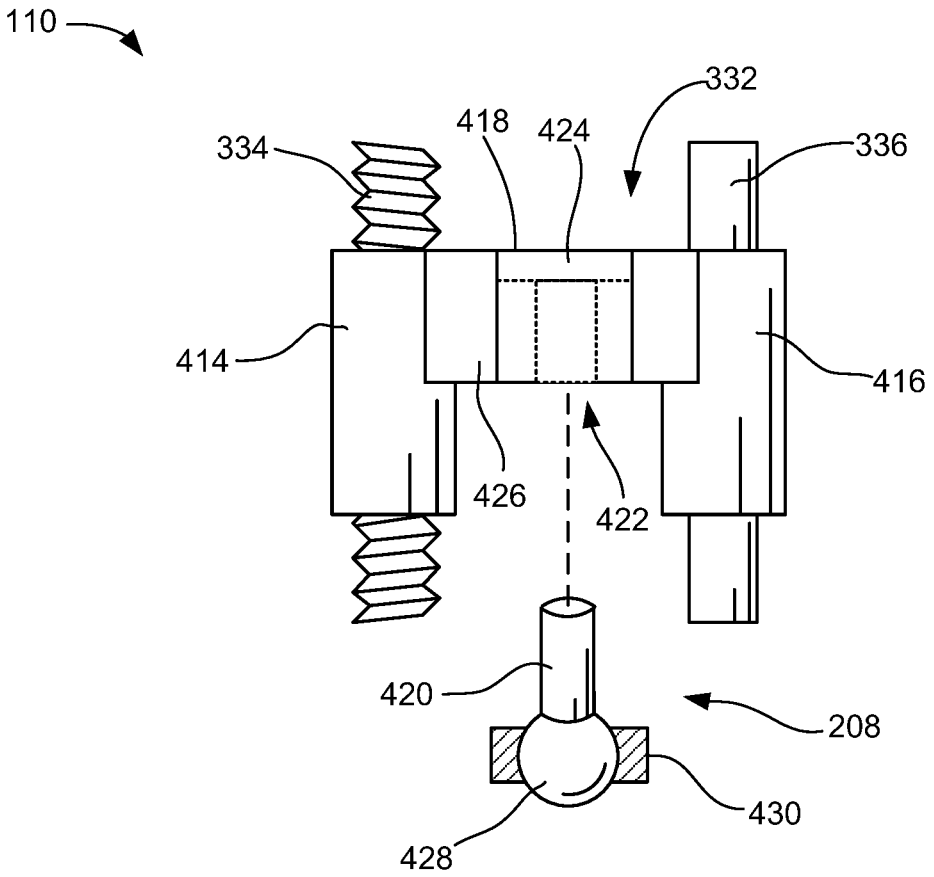
FIGS. 18A and 18B are simplified schematic representations of an adjustment mechanism of the base assembly.

FIG. 18A shows further aspects of the adjustment mechanism 332 of FIG. 13 in combination with the engagement mechanism 208 of FIG. 9. As described above, the adjustment mechanism 332 is moved vertically along the threaded shaft 334 and the cylindrical shaft 336 via user rotation of the threaded shaft by the knob 338 (see FIGS. 14B and 14C) to set the desired sharpening angle applied to the rod 202 of the abrasive assembly 130.

Figure 18B:
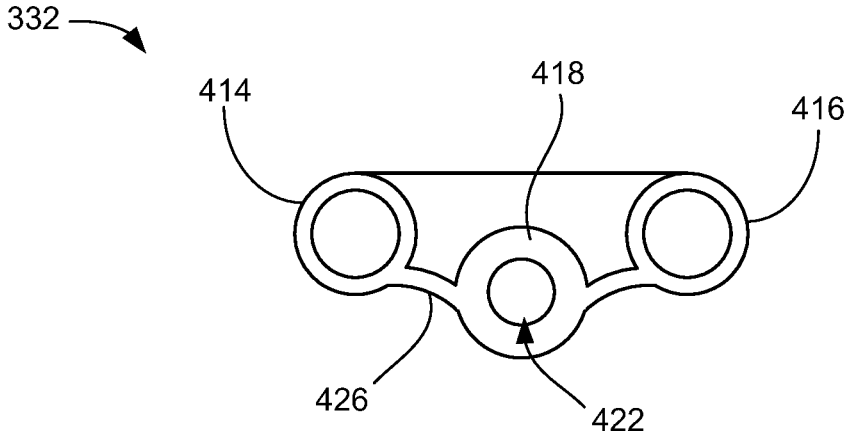

The adjustment mechanism 332 includes a threaded member 414 which engages the threaded shaft 334, a cylindrical member 416 which slidingly engages the cylindrical shaft 336, and a central member 418 which receivingly engages a rod 420 of the engagement mechanism 208. A central aperture 422 extends upwardly into the member 418. An embedded magnet 424 is used to retain the rod 420 within the aperture 422. Webbing 426 interconnects the respective members 414, 416, and 418, as further illustrated in FIG. 18B.

The engagement mechanism 208 at the end of the rod 202 has a cylindrical ball 428 coupled to the rod 420 which is embedded within a housing 430 to form a ball-socket joint arrangement. Both the adjustment mechanism 332 and the housing 430 of the engagement mechanism 208 can be formed of injection molded plastic or other suitable material.

Figure 19A:
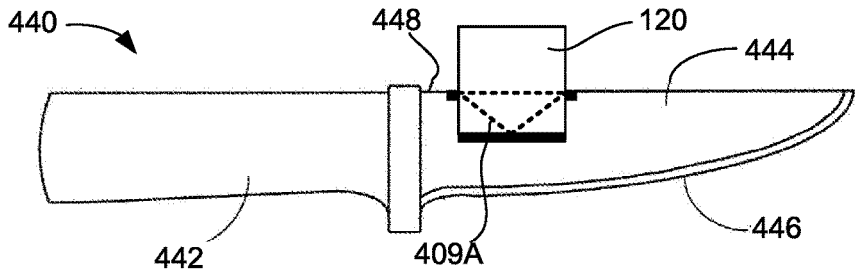
FIGS. 19A through 19C illustrate different types of cutting tools (e.g., knives) that can be sharpened by the sharpener.
Figure 19B:
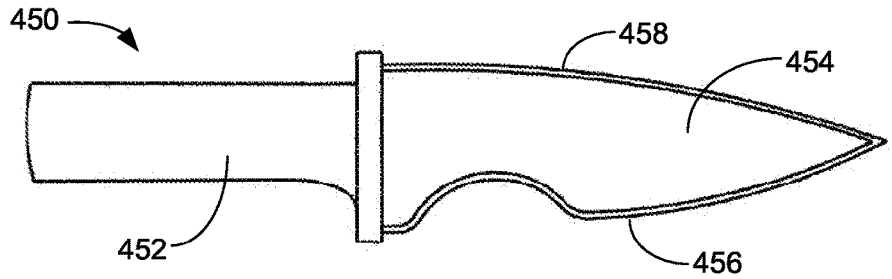
Figure 19C:
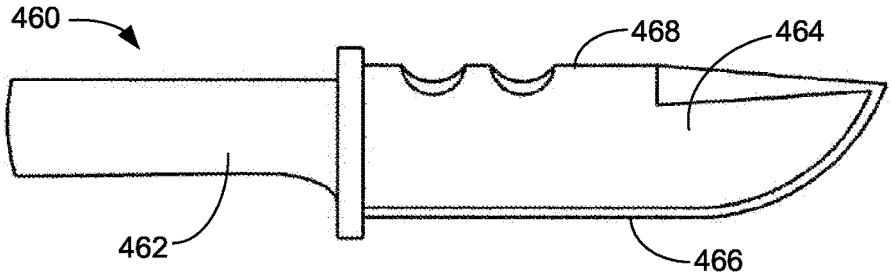

FIGS. 19A through 19C show further examples of cutting tools 440, 450 and 460 that can be sharpened by the sharpener 100 in accordance with various embodiments. FIG. 19A shows the cutting tool 440 as a kitchen knife with handle 442 and blade 444 extending therefrom with curvilinearly extending cutting edge 446 and opposing spine 448. A portion of the blade fixture 120 is shown affixed to a medial portion of the knife 440. A multi-point contact arrangement on the first side of the blade 444 is denoted at 409A. A similar multi-point contact arrangement is contemplated on the second side of blade 444 (not shown).

FIG. 19B shows a double sided knife 450 with handle 452, blade 454 and opposing cutting edges 456, 458. Sharpening the knife 450 can include presenting a first cutting edge (e.g., 456) for sharpening, followed by presenting the opposing second cutting (back or spine) edge (e.g., 458), while clamping the respective sides of the knife in turn as generally depicted in FIG. 19A. It is anticipated that a second cutting edge may be formed on the spine (back edge 458). Both cutting edges may be sharpened by subsequently bringing each edge (456 or 458) into contact with the guide to present the respective opposing edge (456 or 458) for sharpening.

FIG. 19C shows yet another knife 460 generally characterized as a Bowie knife with handle 462, blade 464, cutting edge 464 and spine 468. The spine includes various cutting features such as a back blade and scalloped regions, which can be individually sharpened using the sharpener as desired, or via other sharpening mechanisms.

Figure 20A:
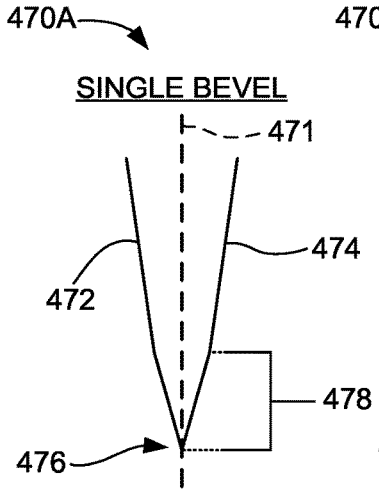
FIGS. 20A through 20C show different sharpening geometries that can be achieved upon a cutting tool by the sharpener in some embodiments.
Figure 20B:
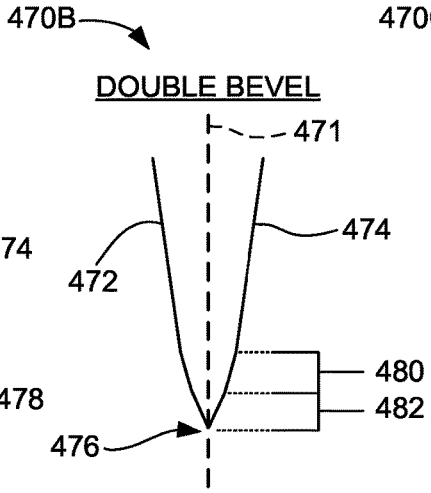
Figure 20C:
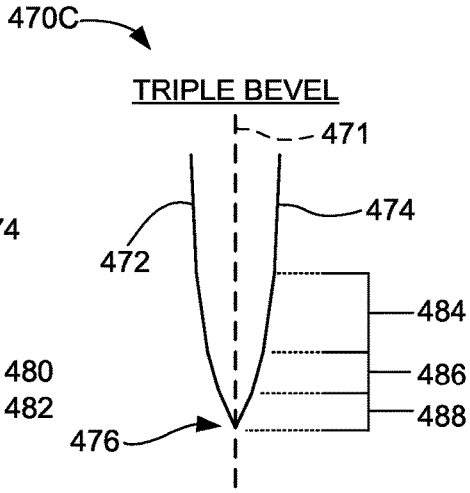

FIGS. 20A through 20C show different sharpening geometries that can be applied to the various blades depicted herein, including but not limited to the cutting tools 10, 190, 400, 440, 450 and 460. FIGS. 20A-20C show respective blades 470A, 470B and 470C, each having main side surfaces 472, 474 which taper to a cutting edge 476.

The blade 470A in FIG. 20A has a single bevel geometry, with a single bevel 478 that extends on each side of the blade to the cutting edge 476. This configuration can be obtained by performing one or more sharpening operations upon the blade 470 using the various abrasive members 222, 224 and 226 all at the same adjusted angle using the adjustment mechanism 332 in FIGS. 18A and 18B. Any suitable angle can be provided for the beveled region 478, such as on the order of around 20 degrees with respect to a bisecting axis 471. It will be understood that the bisecting axis 471 is collinear with the central blade plane 165 discussed above (see e.g., FIGS. 1B and 5).

The blade 470B in FIG. 20B has a double bevel geometry, with two beveled regions 480 and 482 on each side of the blade. This geometry can be obtained by performing a first sharpening operation with a first abrasive member, such as the member 224 at a first angle (such as about 20 degrees), followed by a second operation with a second abrasive member, such as the member 226 at a second, larger angle (such as about 25 degrees). The greater angle of the beveled region 482 can enhance durability of the cutting edge 476.

The blade 470C in FIG. 20C has a triple bevel geometry, with three beveled regions 484, 486, and 488 on each side of the blade. Each of these bevels has an successively increased sharpening angle (e.g., 20 degrees, 23 degrees, 26 degrees, etc.) obtained using each of the respective abrasive members 222, 224, 226. Other precise sharpening geometries can be obtained as desired, including beveled surfaces separated by as little as a single degree or less, depending upon the fine adjustment of the mechanism 332 applied by the user. The respective beveled surfaces in FIGS. 20A-20C are linear (e.g., flat) because the corresponding abrasive surfaces of the abrasive members 222, 224, 226 (see FIG. 12A) are flat. Other geometries can be provided however; convex abrasive surfaces will tend to impart concave beveled surfaces, etc.

Figure 21:
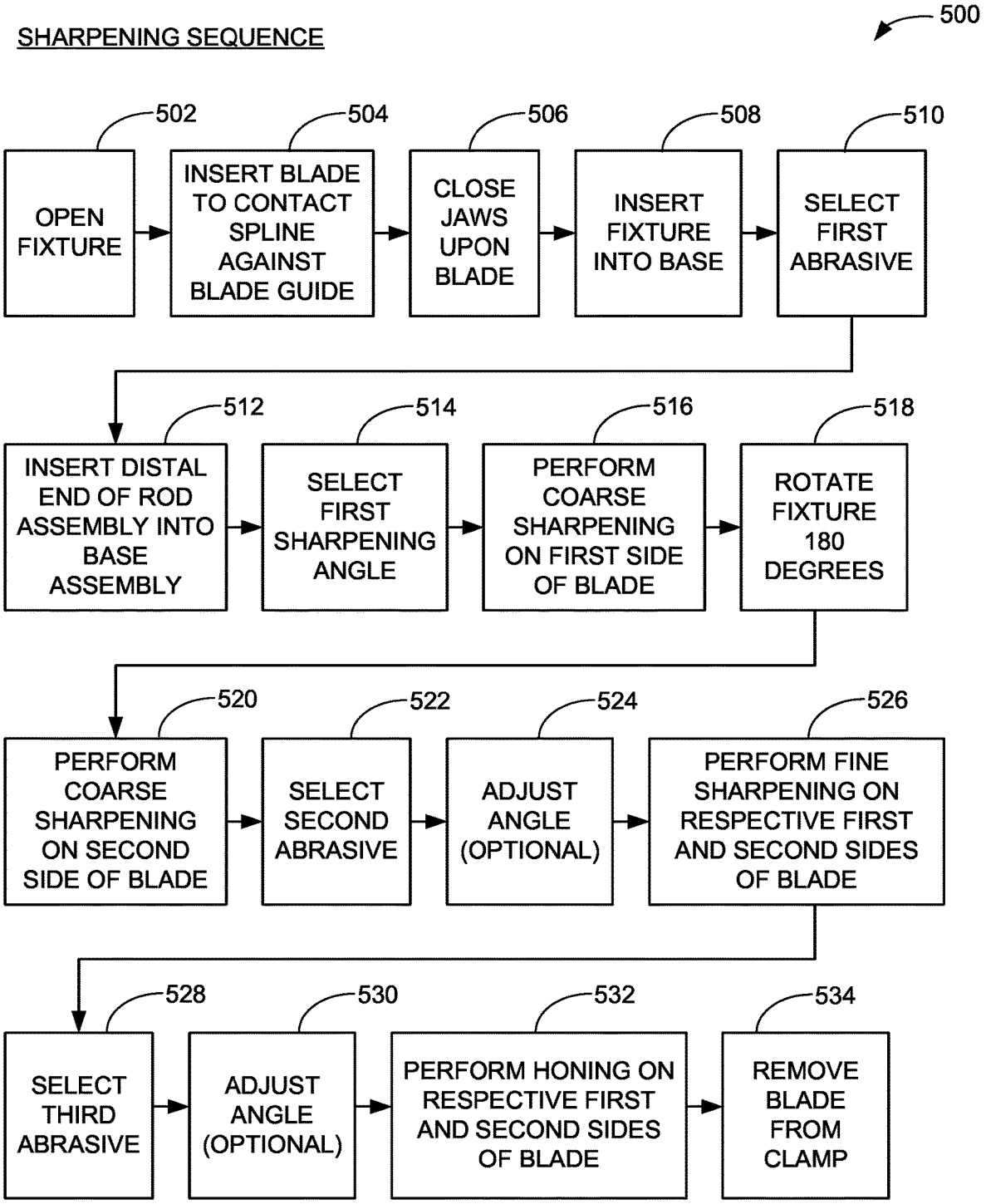
FIG. 21 is a flow diagram for a sharpening sequence carried out in accordance with some embodiments.

FIG. 21 is a flow diagram 500 to illustrate a sharpening sequence that can be carried out upon a selected cutting tool, such as the kitchen knife 10 in FIGS. 1A-1B, using the sharpener 100. It will be appreciated that the sequence in FIG. 21 is merely illustrative and is not limiting, so that other steps can be carried out as desired.

The sequence commences at block 502 where the blade fixture 120 is opened to receive the blade of the knife, which is inserted between the respective clamping jaws 140, 142. It is contemplated that the spine or otherwise opposing side of the blade opposite the cutting edge to be sharpened will be brought into contacting engagement with one or more guides (see e.g., FIGS. 8A-8D), block 504, after which the jaws are tightened onto the sides of the blade through user activation of the knob 154, block 506.

At block 508, the distal end 136 of the blade fixture 120 is inserted into the base 110 through placement into the receiving slot 350, as described above in FIG. 16. A first abrasive member is selected at block 510; it is contemplated that the flow of FIG. 21 will utilize the triangular arrangement of FIG. 12A and will apply all three abrasive members to the blade in turn. In practice, the first abrasive member may be only utilized periodically to provide coarse shaping, so that routine touch up sharpening operations on a previously sharpened tool may only involve the second and/or third abrasive member. In this example, however, the first abrasive member 222 is selected at block 510. This will include user rotation of the cartridge 212 within the frame 210 to present the first abrasive member 222 in facing relation away from the handle 220 (see FIGS. 9, 10A-10B).

The abrasive assembly 130 is attached to the base assembly 110 at block 512. This includes insertion of the rod 420 into slot 422, as described above in FIG. 18A. This couples the distal end of the abrasive assembly 130 (via rod 202) to the base assembly. A first sharpening angle is selected at block 514. This can include user rotation of the knob 338 to advance the adjustment mechanism 332 to a suitable angle. The printed indicia (340, 342 in FIG. 14B) can be used to precisely set a desired sharpening angle. A digital angle guide could also be used to determine the correct angle as desired. As noted above in FIGS. 20A-20C, a suitable initial angle can be about 20 degrees, although other values can be used.

At block 516, a coarse sharpening operation is carried out by the user using the abrasive assembly 130. This involves grasping of the handle 220 by the user and lightly moving the first abrasive member along the entirety of the exposed cutting edge of the clamped blade. Care should be taken to keep the user's hands away from the clamped blade. Long strokes along the entirety of the cutting edge, such as 8-10 strokes, may be sufficient to carry out the coarse sharpening operation. Damaged areas can be provided additional motion of the sharpening member therealong. A small amount of residue (swarf) will likely be generated as a result of the sharpening operation. This swarf can be carefully wiped off between sharpening operations using a cloth or other suitable member.

Once the coarse sharpening operation has been applied to the first side of the blade, the blade can be rotated 180 degrees at block 518 to present the second, opposing side of the blade for sharpening. This rotation can be carried out as described above in FIG. 16, whereby the user depresses the mechanism 382, allowing the blade fixture and cup to be rotated through this desired angular range. Alternatively, the user can carefully pull the fixture and blade out of the receiving slot, rotate the same, and then reinsert in the desired configuration.

At block 520, a coarse sharpening operation is carried out upon the second side of the blade as described above. It is contemplated albeit not necessarily required that the sharpening operations using the same abrasive media will be carried out at the same nominal angle on both sides of the blade, thereby providing a symmetric sharpening geometry as depicted in FIGS. 20A-20C.

Once the coarse sharpening operation is completed, the flow passes to block 522 where a second abrasive is selected, such as abrasive member 224 (see e.g., FIG. 12A). As desired, an adjustment can be made to the sharpening angle at block 524 at this time, such as by increasing the angle by a small amount (e.g., 2-5 degrees, etc.). The foregoing sharpening operations are repeated at block 526 so that the second abrasive member 224 is again lightly moved by the user along opposing sides of the blade along the cutting edge. The first sharpening operation may have raised a burr along the cutting edge; if so, the fine sharpening operation of block 526 will tend to remove this burr. A total of 8-10 strokes may be sufficient to complete this sharpening on each side.

Once the fine sharpening operation is completed, the flow passes to block 528 where the third abrasive is selected, such as the abrasive member 226. An adjustment to the sharpening angle can be optionally carried out at block 530, after which a honing operation is applied at block 532 using the third abrasive member. This will polish and otherwise refine the cutting edge to an exceptional level of sharpness. As before, the honing operation is applied to each side of the blade in turn (such as 8-10 strokes). Once completed, the blade is removed from the clamp, block 534.

Figure 22:
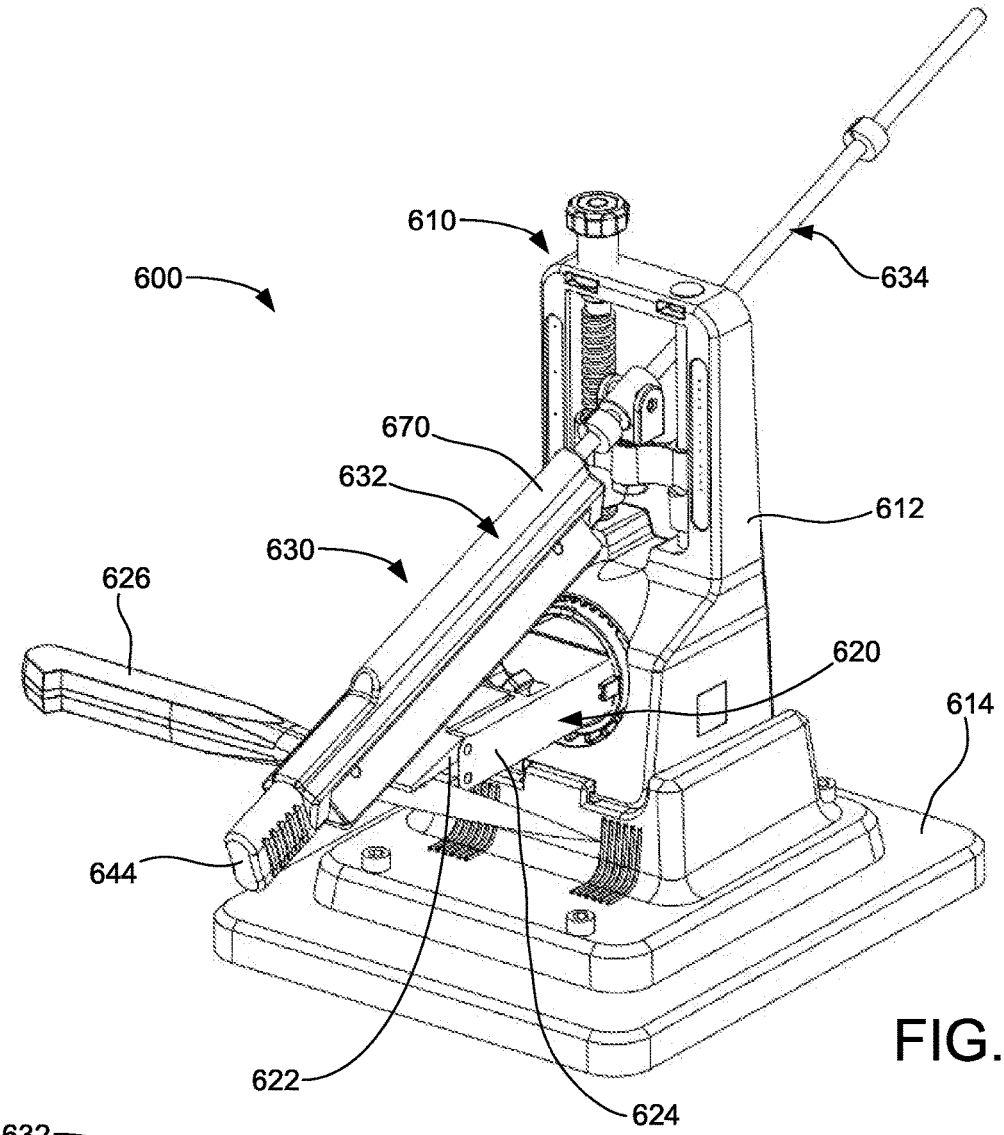
FIG. 22 shows another manual cutting tool sharpener in accordance with further embodiments.

FIG. 22 shows another manual cutting tool sharpener 600 in accordance with further embodiments. The manual cutting tool sharpener 600 is generally similar to the sharpener 100 set forth above. As such, various elements in the sharpener 600 can be utilized in the sharpener 100, and vice versa, as desired. The sharpener 600 includes a base assembly 610, a blade fixture (clamp assembly) 620 and an abrasive assembly 630.

Of particular interest is the abrasive assembly 630 which will be described in detail below. At this point, however, it will be noted that the base assembly 610 includes a tower assembly 612 supported by a base pedestal 614. The fixture 620 includes opposing upper and lower clamping jaws (one denoted at 622) and a main body 624 configured to be inserted into a corresponding receptacle slot in the tower assembly 612. The fixture 620 is shown to secure a cutting tool (knife) 626.

The abrasive assembly 630 includes an abrasive block 632 affixed to a rod 634. As further shown in FIG. 23, the block 632 includes a generally u-shaped frame (housing) 636 with a longitudinally extending base portion 638 and downwardly depending flange support portions 640, 642 at each end thereof. A user handle 644 extends from flange support portion 640.

An abrasive cartridge 646 is removably attachable to the housing 636. The abrasive cartridge 646 has a main body 648 with a substantially triangular cross-sectional shape to support respective first, second and third abrasive members 650, 652 and 654. Each of the members have a corresponding abrasive surface, and each of these surfaces may have a different abrasiveness level as described above. As before, some other number of abrasive members can be incorporated into the cartridge 646.

A steel pivot shaft extends through the main body 648 with opposing, projecting ends 656, 658. Each end is cylindrical and sized to nest within a corresponding saddle (slot) 660, 662. Magnetic retention features, such as magnets (one partially shown at 664) can be used to engage the ends 656, 658 and retain the cartridge within the frame 636. Other coupling arrangements can be used.

Figure 23:
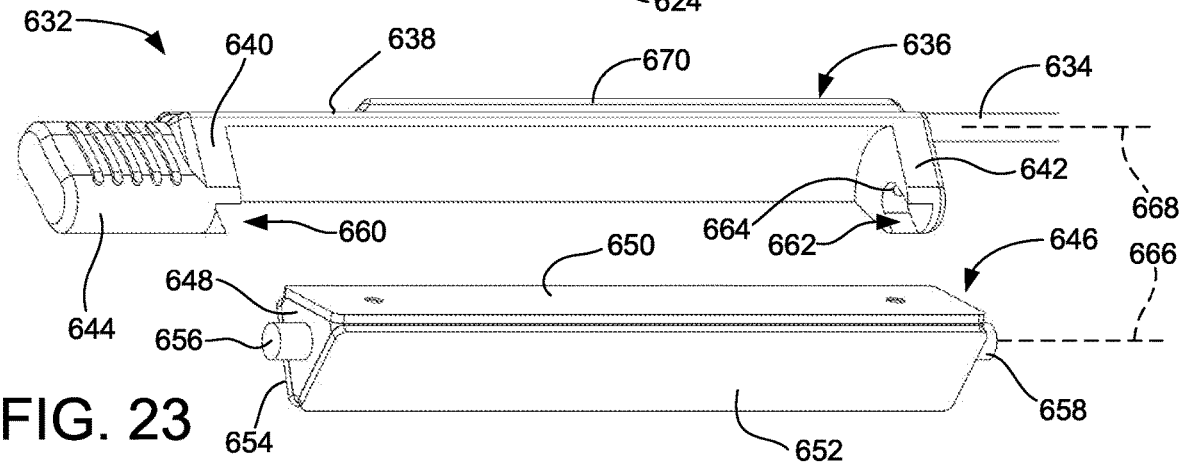
FIG. 23 is an exploded, isometric depiction of an abrasive assembly of the sharpener of FIG. 22.

The arrangement in FIG. 23 permits the cartridge 646 to rotate to follow the profile of the blade independently of the movement of the handle 644 on the frame 636. The friction between the saddles/magnets and the steel pivot shaft will further allow the cartridge to rotate under pressure from the cutting edge but not, freely rotate when lifted off the blade. As desired, the user can easily remove a first cartridge from the frame and install a different, second cartridge to accommodate further sharpening operations.

The cartridge 646 extends along and rotates about a central cartridge axis 666 when the cartridge is installed into the frame. This cartridge axis 666 is offset from a corresponding rod axis 668 which extends along the rod 634. In this way, the rod axis is parallel to, but not coaxial with, the axis about which the abrasive pivots. The rod 634 extends into and along a majority of the length of the frame 636, as denoted by receiving projection 670 (best viewed in FIG. 22), to enhance stiffness of the frame. It will be appreciated that the respective cartridge and rod axes 666, 668 could instead be made coaxial, as desired.

Figure 24:
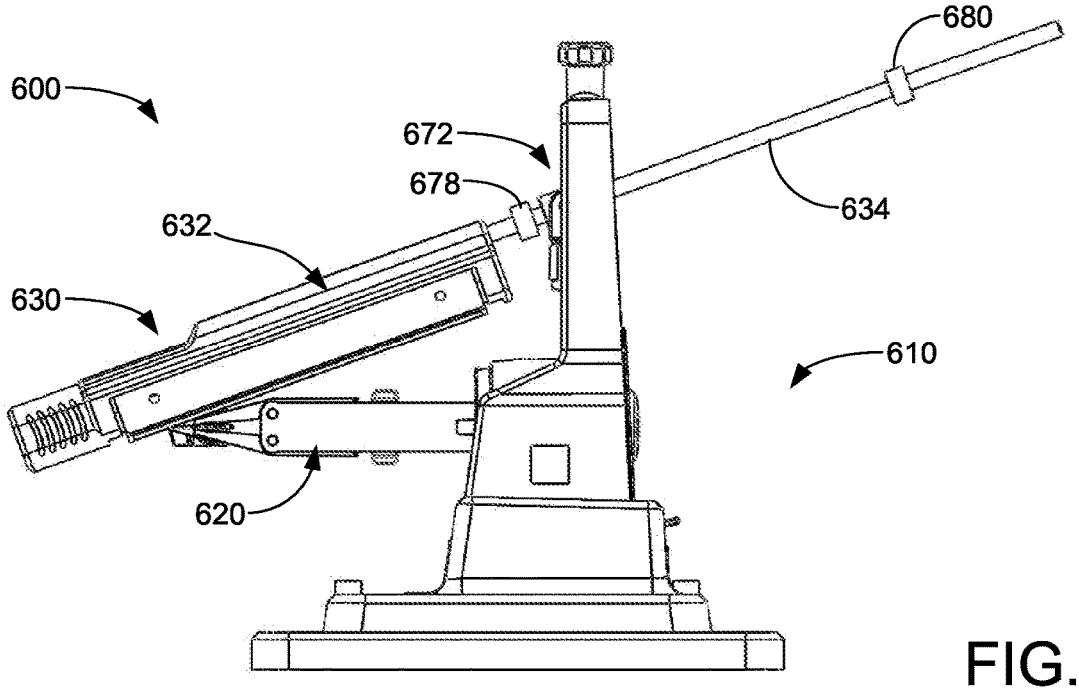
FIG. 24 is a side view of the sharpener of FIG. 22.
Figure 25:
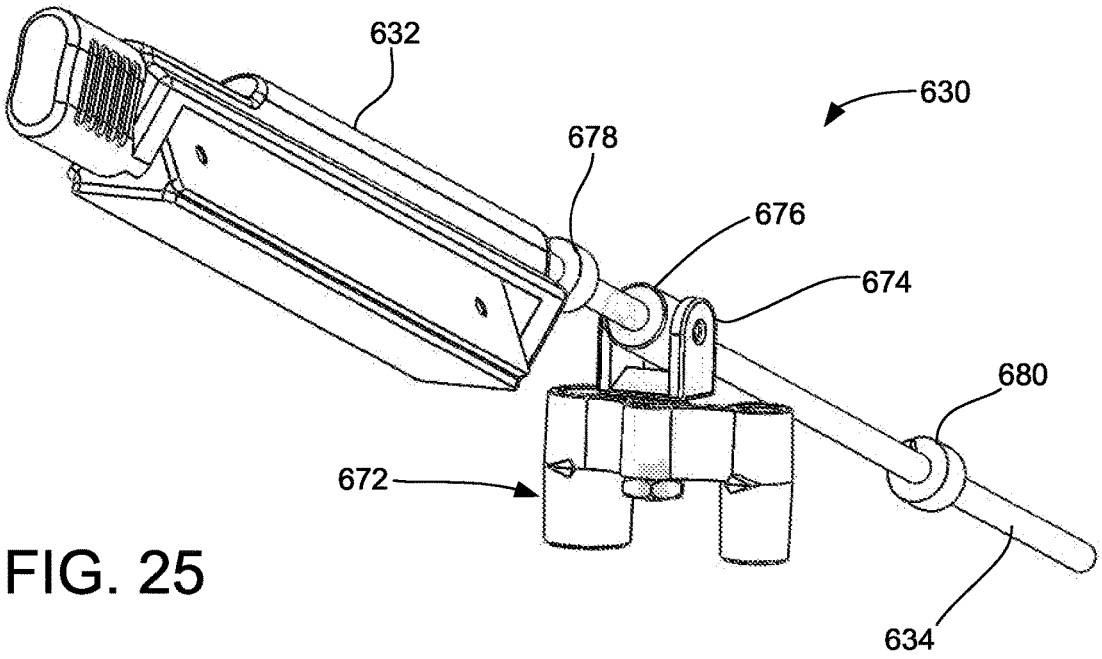
FIG. 25 shows an isometric depiction of the abrasive assembly of FIG. 24.

FIGS. 24 and 25 show the abrasive assembly 630 in further detail. FIG. 24 is a side view of the sharpener 600 from FIG. 22, and FIG. 25 is an isometric depiction of the abrasive assembly 630. The abrasive block 632 does not slide along the rod as provided in the embodiments discussed above. Instead, the block is fixedly secured to the rod and a clevis/pivot bearing arrangement is used to enable a distal end of the rod opposite the abrasive block to slide with respect to the base assembly 610.

An adjustment mechanism 672 is vertically raised and lowered within a frame of the base assembly 610 in a manner similar to the adjustment mechanism 332 discussed above in FIG. 18A. A clevis 674 extends from an upper surface of the adjustment mechanism 672 to support a pivot bearing 676. This arrangement allows multi-axial movement of the abrasive block 632 (e.g., side-to-side, up-and-down, in-and-out) with respect to the base assembly 610 and fixture 620. As before, limit stops such as in the form of elastomeric rings 678, 680 can be slidingly advanced along the rod 634 to provide an overall range of movement of the abrasive assembly 630 during sharpening.

Figure 26:
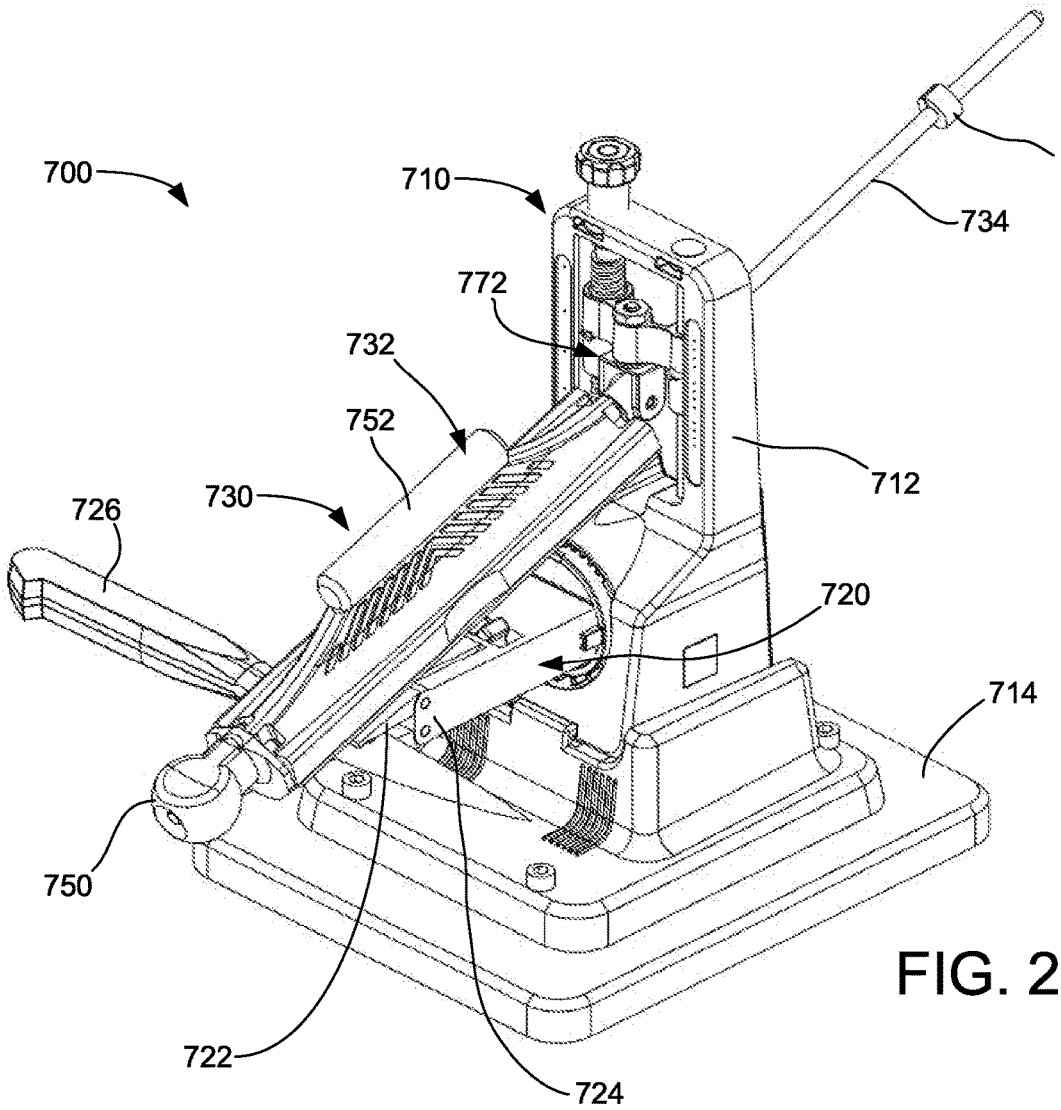
FIG. 26 shows yet another manual cutting tool sharpener in accordance with further embodiments.

FIG. 26 shows another manual cutting tool sharpener 700 in accordance with further embodiments. The sharpener 700 presents yet another alternative abrasive assembly, which will be discussed below. The sharpener 700 is similar to the sharpeners 100, 600 discussed above in that it includes a base assembly 710, a fixture (clamp assembly) 720 and an abrasive assembly 730. As before, the base assembly 710 has a tower assembly 712 and a pedestal 714. The fixture 720 has opposing clamping jaws (the topmost of which is depicted at 722) and a main body 724 configured for insertion into a receiving slot into the base assembly 710. The fixture 720 is shown to have clamped a cutting tool (knife) 726 for a sharpening operation.

Figure 27:
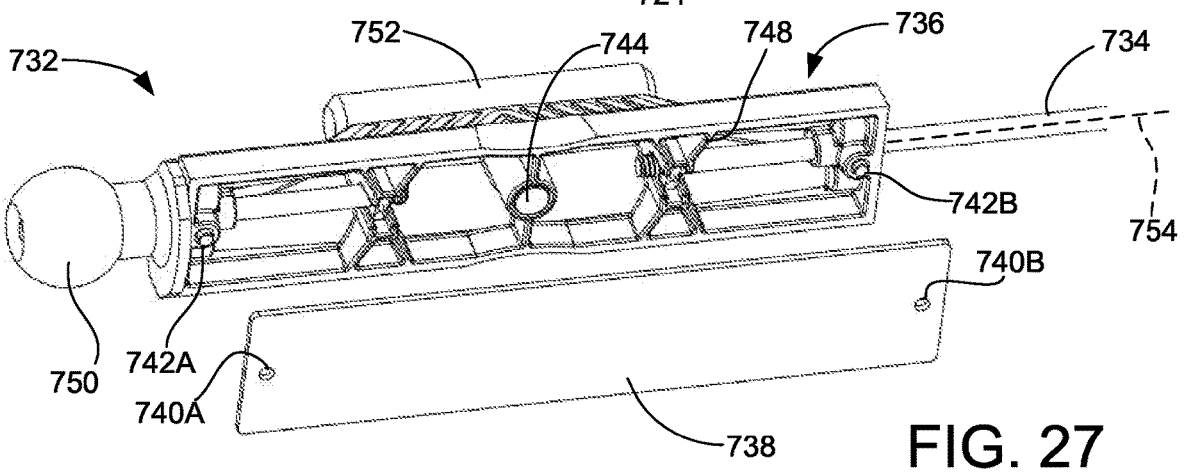
FIG. 27 is an exploded depiction of an abrasive assembly of the sharpener of FIG. 26.

The abrasive assembly 730 is a swing-arm type module including an abrasive block 732 attached to a rod 734. As further shown in FIG. 27, the block 732 includes a frame (housing) 736 adapted to receive an abrasive member (plate) 738 having a corresponding abrasive surface. In the arrangement of FIG. 27, the abrasive member 738 constitutes a magnetically permeable plate with through holes 740A, 74013 sized to accommodate corresponding pins 742A, 742B projecting from the frame 736. Magnet 744 is fixed in the frame 736 and magnetically restrains abrasive member 738 such that the abrasive member 738 is held in place with respect to the frame 736 during sharpening but is easily removable by the user as desired.

A number of recessed surfaces (e.g., ribs 748) provide a support platform so that the plate 738 is supported and retained in a flush arrangement against the frame 736 once the plate is mated to the frame. This attachment arrangement allows the user to remove and install different plates with different abrasiveness levels in turn. This arrangement can also be implemented in the other sharpeners discussed above (see e.g., FIG. 23). As before, other plate attachment mechanisms can be used.

The abrasive block 732 is further shown in FIGS. 26 and 27 to include two available user handles; a first handle 750 and a second handle 752. The first handle 750 is disposed at a proximal end of the frame 736 in a manner similar to the handle 644 discussed above in FIGS. 22-23. In this way, the user can direct the sharpening operation by grasping the end of the abrasive assembly 730 via the handle 750. However, unlike the axially offset arrangement of FIGS. 22-23, the handle 750 is coaxial with a rod axis 754 of the rod 734 (see FIG. 27).

The second handle 752 is mounted above the abrasive assembly 730 in a manner similar to the handle 220 in FIG. 9. In this way, the user has the option to guide the sharpening operation via the handle 752. However, in at least some embodiments, the handle 752 further operates as a counterweight having a mass that is sized and placed to counterbalance the abrasive plate 738 during the sharpening operation.

In this way, if the user elects to sharpen via the first handle 750, the plate 738 can be allowed to freely rotate about the central rod axis 754 and follow the contour of the cutting edge, as before. The handle 750 is configured to rotate independently of the frame 736 to facilitate this independent frame rotation while the handle is held by the user. The abrasive assembly 730 may be balanced such that the plates are heavier (biased to the bottom) as compared to the weight of handle 752 so that the plate is normally urged in a downwardly facing direction, but can tilt as required to follow the blade contour.

Figure 28:
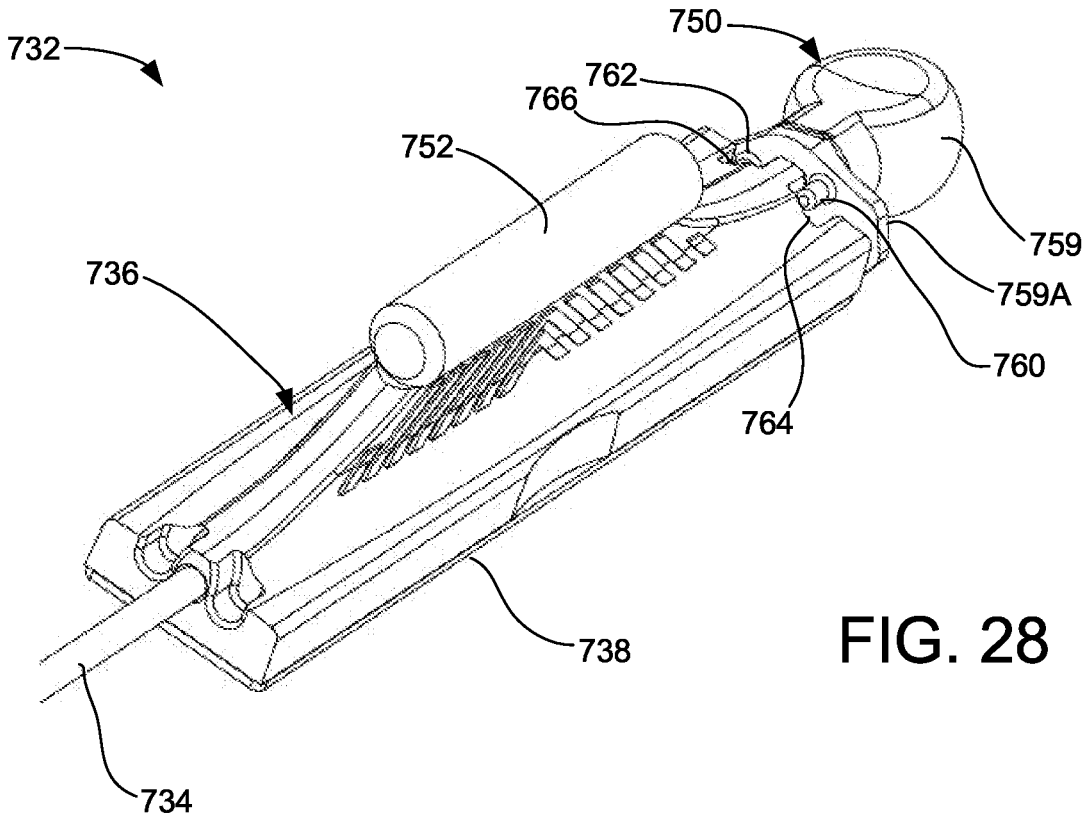
FIG. 28 is another view of the abrasive assembly of FIG. 27.

Limit features may further be used to limit the overall ability of the frame 736 to rotate about the rod axis 754 during a sharpening operation. These limit features are respectively depicted in FIGS. 28 and 29. For reference, FIG. 28 is an isometric depiction of the abrasive block 732, and FIG. 29 is a partial view of the abrasive block 732 with the handle 750 removed for clarity of illustration.

Figure 29:
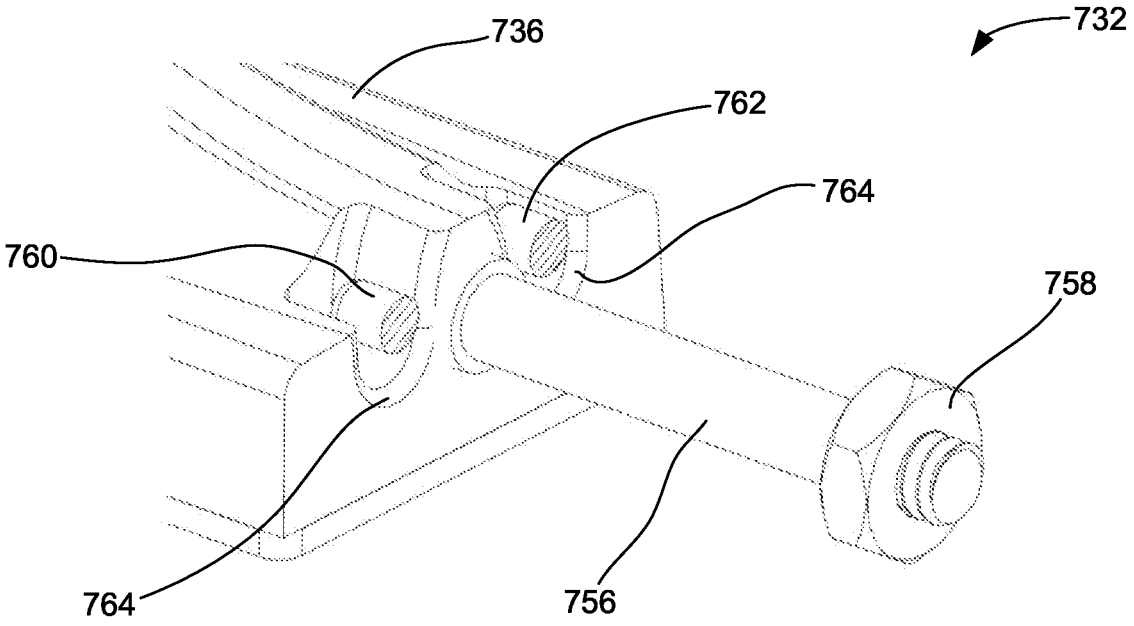
FIG. 29 is an end view of further aspects of the abrasive assembly of FIG. 28.

It will be noted that FIG. 29 shows a threaded shaft 756 and retention nut 758. These elements are used to secure a spherical handle portion, which is shown in FIG. 28 at reference numeral 759. A guide flange 759A, also shown in FIG. 28, projects from the element 759 and can be used to protect the user from the cutting edge of the blade being sharpened. While not shown, a similar guide flange can be incorporated into the abrasive assembly 630 discussed above.

The rotational limit features include a pair of limit stops 760, 762 which project from the guide flange 759A. A corresponding pair of limit slots 764, 766 are formed in the frame 736. The stops 760, 762 are characterized as cylindrical projections and the slots 764, 766 are characterized as u-shaped channels, but other limit feature arrangements can be used.

These features ensure that only a maximum amount of rotation can be applied to the frame 736 about the rod axis 754, in each of two opposing rotational directions (e.g., clockwise and counter-clockwise). Such rotation is limited based on contacting engagement between the respective stops and slots. A total rotational range of nominally +/−20 degrees has been illustrated in FIGS. 28-29, although other values can be used including values greater or lesser than this range. Without limitation, other ranges can include +/−5 degrees, +/−10 degrees, +/−12 degrees, +/−15 degrees, +/−25 degrees, and so on.

Figure 30A:
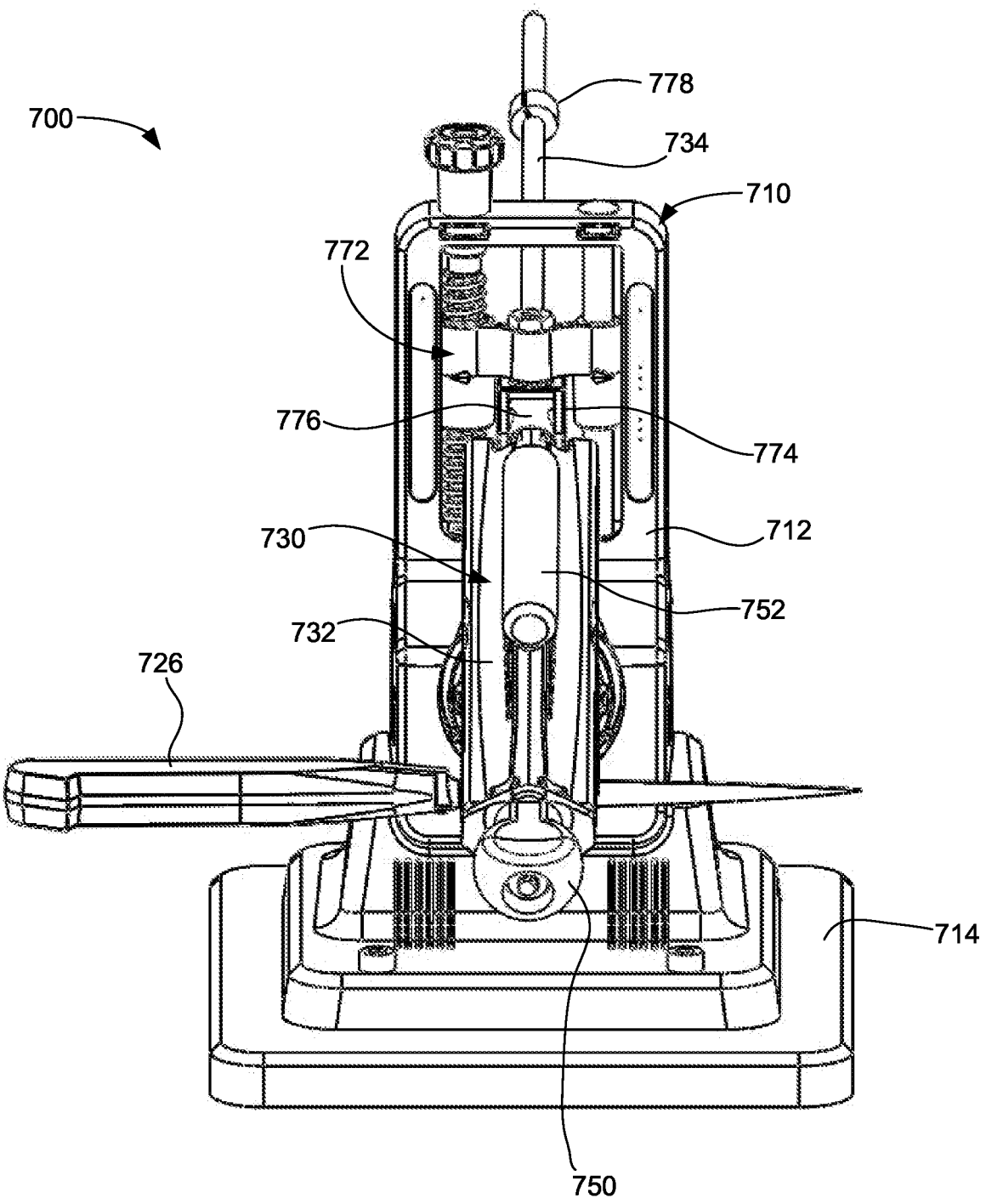
FIGS. 30A and 30B show a sharpening operation carried out upon a cutting tool (knife) using the sharpener of FIG. 26.
Figure 30B:
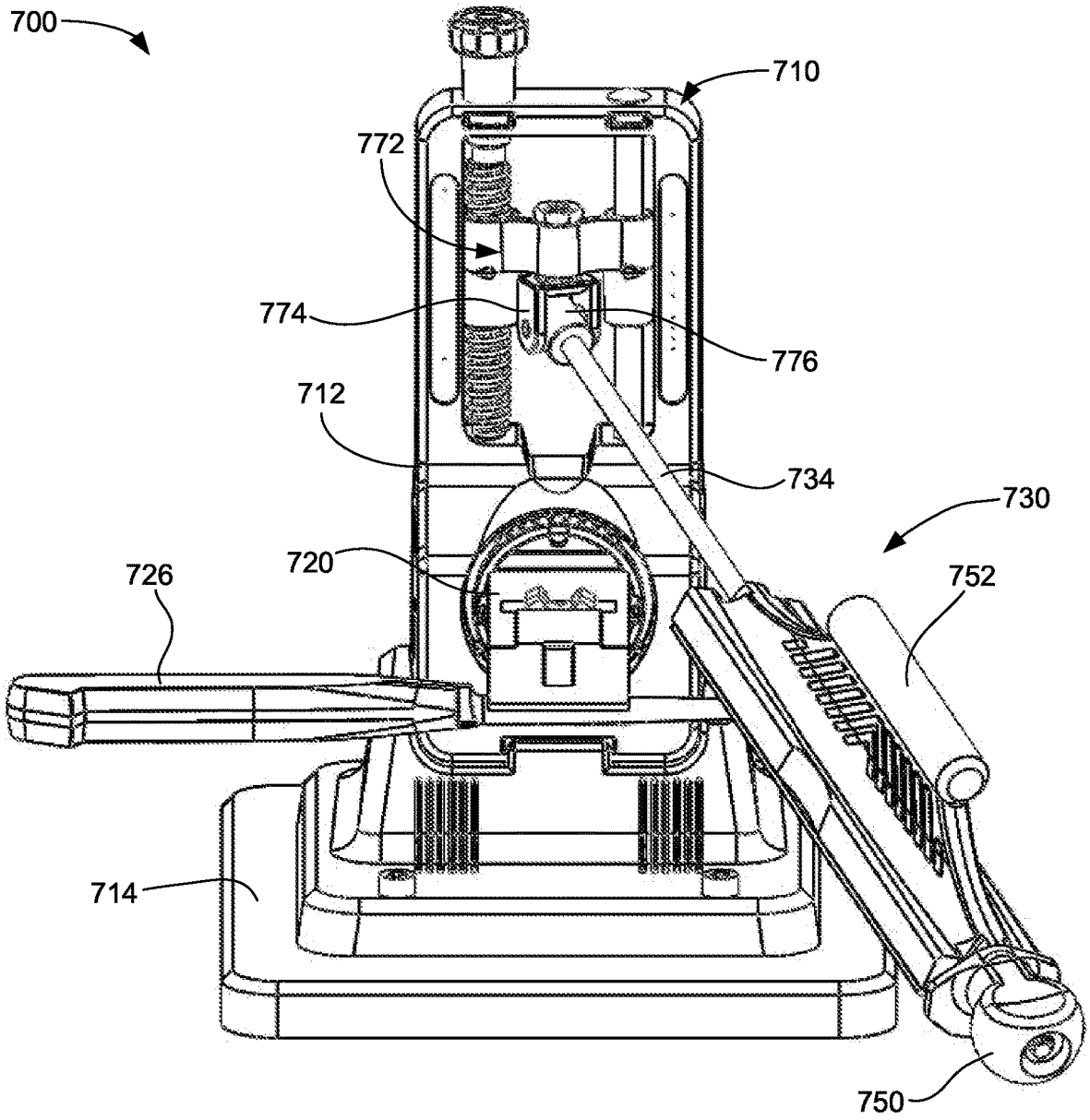

The abrasive assembly 730 is coupled to the base assembly 710 using a clevis/pivot beating arrangement similar to that of the sharpener 600, except that the relative orientation of the respective elements may be reversed (e.g., the clevis and pivot bearing may extend downwardly as depicted in FIG. 26). As best shown in FIGS. 30A and 30B, an adjustment mechanism 772 is raised or lowered to set an appropriate sharpening angle by the user. The adjustment mechanism has a projecting clevis 774 and pivot bearing 776 to facilitate multi-axial movement of the rod 734 and hence, the abrasive block 732, by the user.

FIG. 30A shows a suitable placement of the abrasive assembly 730 during the sharpening of a medial portion of the cutting tool 726 (from FIG. 26); FIG. 30B shows another suitable placement of the abrasive assembly 730 during the sharpening of a distal end of the blade of the cutting tool 726. The rotational capabilities of the abrasive member with respect to the handle during the sharpening operation are readily apparent from a comparison of FIGS. 30A and 30B. A limit stop 778 such as an elastomeric ring, can be used to limit the overall travel of the rod, as before.

Figure 31:
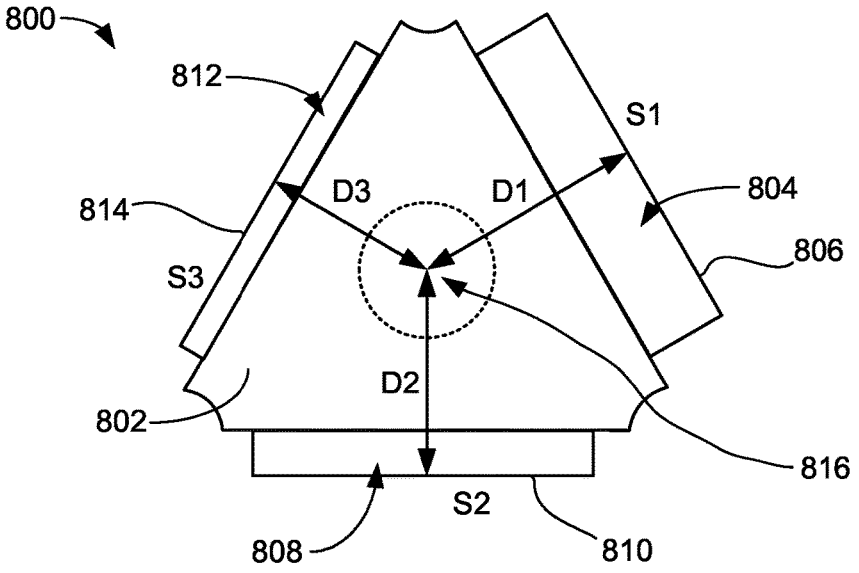
FIG. 31 shows another configuration for an abrasive assembly in accordance with further embodiments.

FIG. 31 shows a schematic depiction of relevant portions of another abrasive block 800 in accordance with further embodiments. It will be understood that FIG. 31 can represent operational aspects of various abrasive blocks such as but not limited to those set forth by FIGS. 9, 22, 26, etc.

In FIG. 31, a main body 802 supports a total of three spaced apart abrasive members. These include a first abrasive member 804 having associated abrasive surface 806 (denoted at S1), a second abrasive member 808 with abrasive surface 810 (S2), and a third abrasive member 812 with abrasive surface 814 (S3). As before, the use of three (3) abrasive surfaces is merely exemplary and is not limiting, as any number of abrasive surfaces can be supplied in accordance with the foregoing discussion. This includes examples where abrasive members can be removed and installed in the same support structure.

Of particular interest in the configuration of FIG. 31 is the fact that the respective abrasive surfaces S1, S2 and S3 (806, 810, 814) of the abrasive members 804, 808, 812 are all at different respective radial distances from a centerline of the main body 802. This centerline is numerically denoted at 816. It will be recalled that this centerline may nominally align with an axis of rotation for the abrasive assembly (e.g., compare FIGS. 2B, 23 and 27), although such is not necessarily required. Any fixed point with respect to the rod axis will suffice.

Regardless, it can be seen that surface S1 is at distance D1, surface S2 is at distance D2, and surface S3 is at distance D3, wherein D1>D2>D3. The relative differences in distance have been exaggerated for purposes of clarity. For embodiments that use replaceable abrasive plates, these types of differences in distance can be achieved using plates of different relative thicknesses. As before, the use of three (3) corresponding members/surfaces/distances is merely exemplary and is not limiting.

Figure 32:
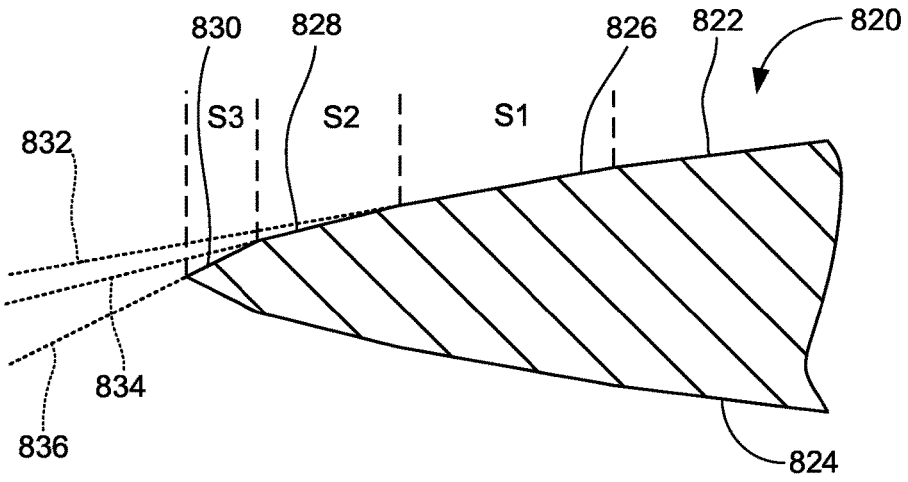
FIG. 32 depicts a portion of a blade sharpened using the abrasive assembly of FIG. 31.

An advantage of such differences in overall distance will now become apparent from a review of FIG. 32, which provides a cross-sectional representation of a blade 820 that has been successively sharpened using the configuration of FIG. 31. The blade 820 has opposing side surfaces 822, 824 which can be grasped by opposing jaw members during a sharpening operation as described above. The geometry applied to upper side surface 822 of the blade can also be applied to the opposing lower side surface 824.

The side surface 822 in FIG. 32 has three (3) bevels, or sub-surfaces, which are generated by application of each of the respective abrasive members 804, 808 and 812 to the side of the blade at the same selected presentation angle as determined by the base assembly 110, 610, 710. These bevel surfaces are respectively denoted at 826, 828 and 830. Corresponding beveled surfaces (not separately numerically denoted) have been provided to the other side 824 of the blade in turn using a similar sharpening sequence (see e.g., FIG. 21).

Of interest is the fact that each of the sharpening operations carried out using the assembly 800 from FIG. 31 to form the surfaces 826, 828, 830 were performed using a single setting of the adjustment mechanism 332, 672, 772 with respect to the base assembly 110, 610, 710. Stated another way, assume that the adjustment mechanism of the base assembly is set to a first selected angle, such as nominally 20 degrees. The differences in relative distance D1, D2 and D3 of the associated abrasive surfaces S1, S2 and S3 would be sufficient to provide a micro-bevel geometry such as represented in FIG. 32, so that the different angles of the respective bevels are accomplished while the same relative angle with respect to the base assembly is maintained constant (e.g., the adjustment mechanism stays fixed at 20 degrees or some other suitable value). It will be appreciated at this point that FIG. 32 is schematic in nature to describe the operation of the system and is not necessarily drawn to scale.

Continuing with FIG. 32, a first sharpening operation to form the first bevel 826 using surface S1 is carried out at a first effective sharpening angle as depicted by broken line 832. A second sharpening operation to form the second bevel 828 using surface S2 is carried out at a second effective sharpening angle as depicted by broken line 834. A third sharpening operation to form the third bevel 830 using surface S3 is carried out at a third effective sharpening angle as depicted by broken line 836.

As noted above, no adjustments in the vertical location of the distal end of the sharpening rod need take place during each of these sharpening operations. Instead, the differences in the distances D1, D2 and D3 provide the microbeveling capabilities illustrated in FIG. 32. Similar operations are applied sequentially to the underside 824 to obtain the overall blade geometry. Accordingly, it is contemplated that at least some variations of the sharpener disclosed herein may have no adjustments in sharpening angle capabilities at all, relying on other features as described herein to provide desired shaping profiles.

Figure 33:
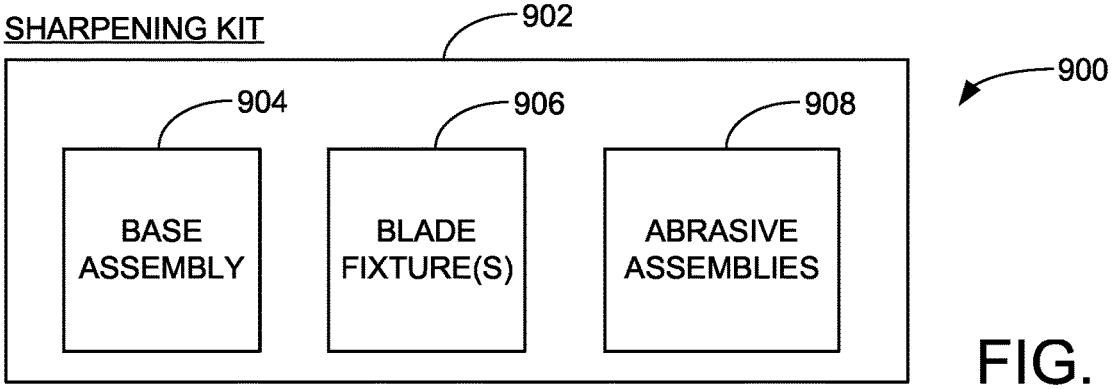
FIG. 33 depicts a sharpening kit that can be constructed and operated in accordance with various embodiments of the present disclosure.

The foregoing discussion shows that a number of different approaches can be used to provide tailored sharpening solutions. As generally represented in FIG. 33, a sharpening kit 900 can conveniently present an array of different abrasive surfaces and/or materials to apply to a given cutting tool.

More specifically, the kit 900 may include a storage case 902 configured to house a base assembly (including but not limited to the various base assemblies 110, 610, 710 discussed above), one or more fixtures (such as the fixtures 120, 620, 720 discussed above), and one or more abrasive assemblies (such as 130, 630, 730) discussed above. The kit could further include multiple cartridges, plates, rods, etc. to facilitate different sharpening applications. In one non-limiting embodiment, the kit can include a base assembly, multiple fixtures (clamp assemblies) to accommodate different sizes, thicknesses, and/or lengths of blades, and multiple abrasive assemblies to provide a number of different sharpening options in terms of different styles and levels of abrasiveness.

Figure 34A:
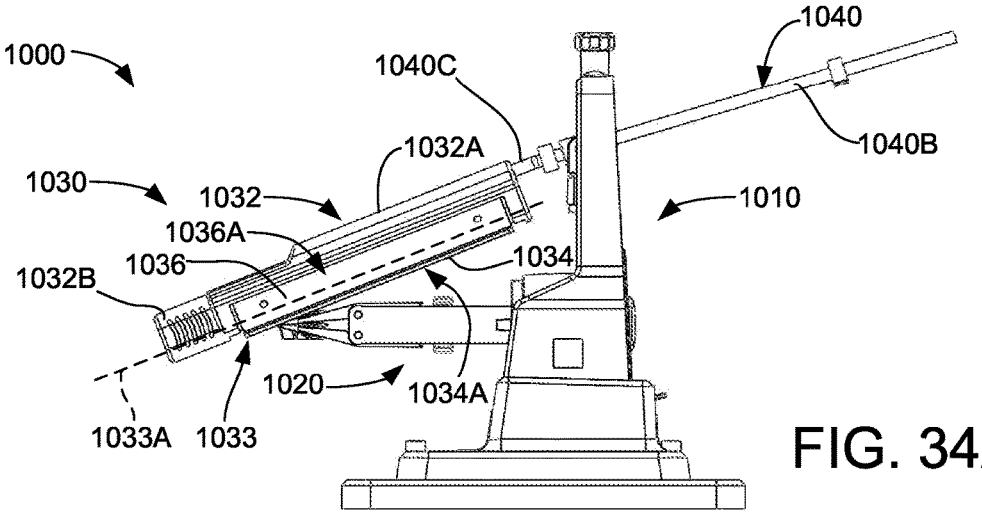
FIGS. 34A and 34B show yet another configuration for a sharpener in accordance with further embodiments.
Figure 34B:
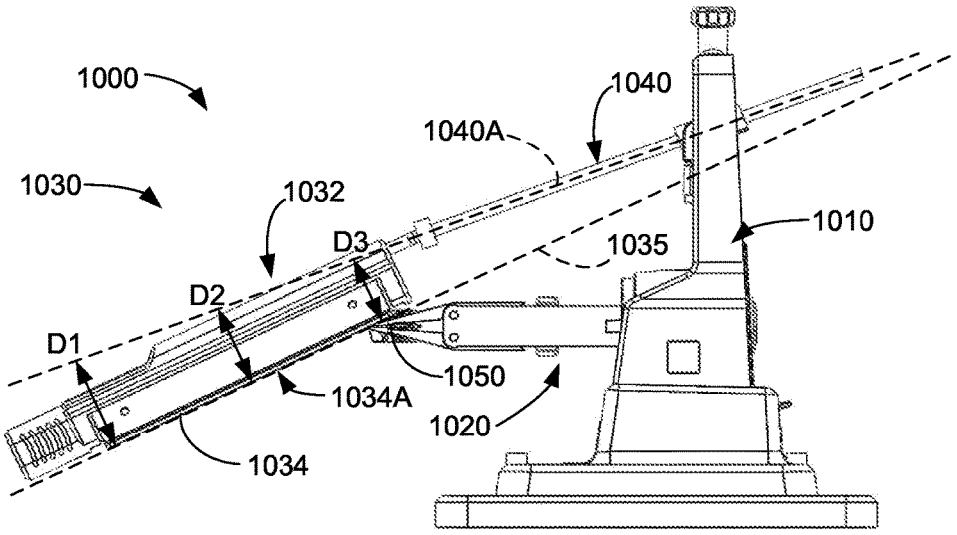

FIGS. 34A and 34B show yet another sharpener 1000 generally similar to the sharpeners 100, 600, 700 discussed above. The sharpener 1000 includes a base assembly 1010, a fixture (clamp assembly) 1020 and a swing-arm style abrasive assembly 1030. The abrasive assembly 1030 includes an abrasive block 1032 affixed to a rod 1040 having a rod axis 1040A (see FIG. 34B). The abrasive block 1032 has a frame 1032A and a handle 1032B, as before.

The abrasive block 1032 further has an abrasive cartridge 1033 that supports three abrasive members, two of which are shown at 1034 and 1036. These abrasive members 1034, 1036 have associated abrasive surfaces 1034A, 1036A. This arrangement is similar to the abrasive assembly 632 and rod 634 discussed above in FIGS. 23-24 except that the abrasive block 1032 is non-parallel to the rod 1040.

In this case, the abrasive surface 1034A is non-parallel to the rod axis 1040A, as indicated by broken line 1035 in FIG. 34B. The intervening angle between the rod axis 1040A and the abrasive surface 1034A can be any suitable value. This arrangement results in a continually varying distance between the abrasive surface 1034A and the rod axis 1040A, such as shown by respective distances D1, D2 and D3 in FIG. 34B. This continually varying distance results in a continually varying angle between the abrasive surfaces of block 1032 and an associated blade 1050 being sharpened as the abrasive block 1032 is moved across the blade.

Figure 35:
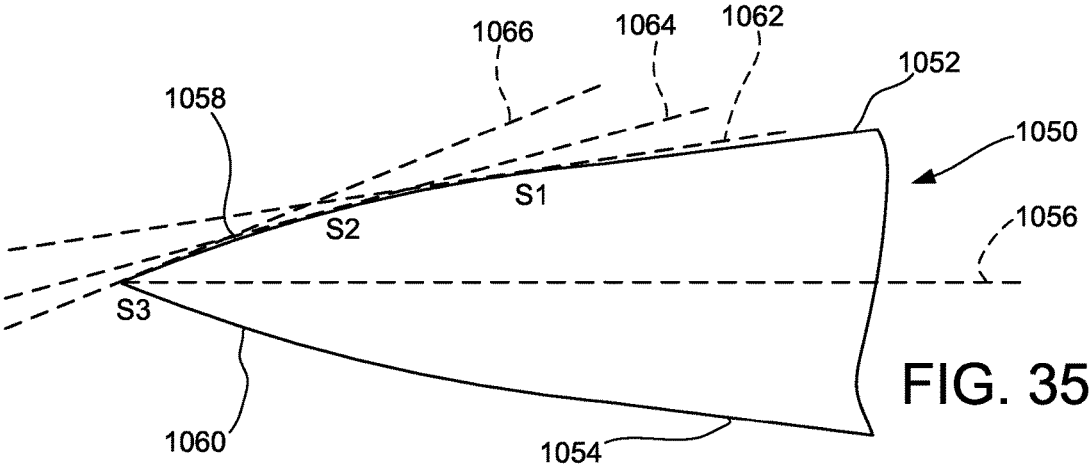
FIG. 35 is a schematic cross-sectional representation of a portion of a blade using the sharpener of FIGS. 34A-34B.

FIG. 35 is a schematic, cross-sectional depiction of the blade 1050 with opposing sides 1052, 1054 and centerline 1056. Curvilinearly extending convex bevels 1058 and 1060 are provided on each of the sides 1052 and 1054. These convex bevels are formed by engagement with the selected abrasive surface of abrasive block 1032 as the abrasive block is drawn across the respective sides of the blade 1050.

Points S1, S2 and S3 in FIG. 35 generally correspond to the distances D1, D2 and D3 of FIG. 34B. Dotted lines 1062, 1064 and 1066 represent the angle of the abrasive surface with respect to the centerline 1056 at the respective points S1, S2 and S3. Note that the longer distance D1 results in a smaller angle as shown by dotted line 1062 at point S1, while the shorter distance D3 results in a larger angle as shown by dotted line 1066 at point S3. It is contemplated that the angle between the blade 1050 and the selected abrasive surface will continually vary between any two points along the length of the abrasive surface as the block is moved between these points.

In various embodiments, the block 1032 may contain one or more abrasive elements. The abrasive elements may be fixed to block 1032 or moveably selectable with respect to a user handle of the block.

As discussed, the abrasive assembly 1030 shows the abrasive block 1032 to be non-parallel to the rod 1040 such that each of the selected abrasive surfaces would be at the same angle with respect to the rod axis 1040A. Other arrangements can be used. For example, in some alternate embodiments, the abrasive block 1032 may be parallel to the rod 1040 but one or more abrasive surfaces may be non-parallel to the block and/or rod.

Finally, it will be noted that FIGS. 34A and 34B show the rod 1040 to have a first segment 1040B that interconnects with the base assembly 1010 and a second segment 1040C that interconnects with the abrasive assembly block 1032. The rod axis 1040A extends along the first segment 1040B. Other arrangements can be used to establish the non-parallel relationship between the rod axis and the abrasive surface. If a rotatable cartridge is used such as at 1033, the cartridge may be configured to rotate about a cartridge axis 1033A (see FIG. 24A) that is offset from and non-parallel to the rod axis 1040A. As before, a non-rotatable abrasive cartridge can be used such as an embodiment where the user removes and reinstalls the cartridge to select the appropriate abrasive surface. While three (3) abrasive members are contemplated, any number of abrasive members can be used such as discussed above in FIGS. 12A-12D.

Figure 36A:
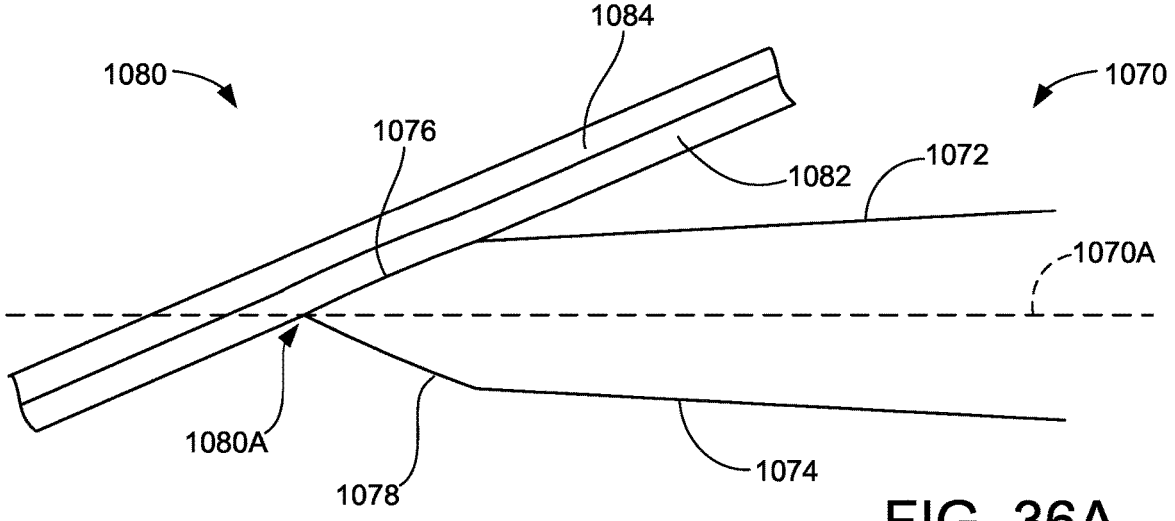
FIGS. 36A and 36B show another blade sharpened with a compliant abrasive assembly in accordance with further embodiments.
Figure 36B:
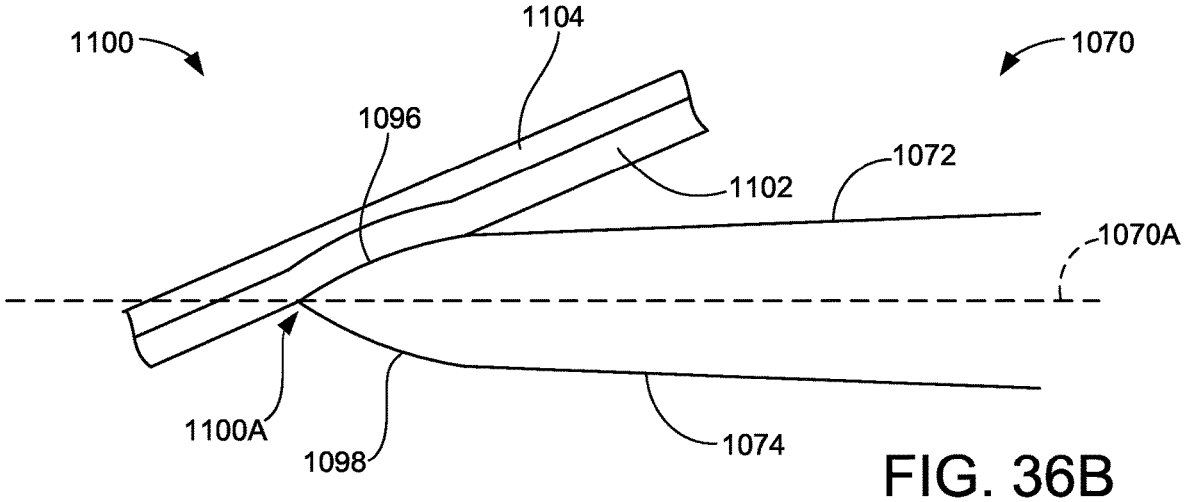

FIGS. 36A and 36B show yet another arrangement of abrasive members that can be implemented in accordance with further embodiments. FIG. 36A shows a first (coarse) sharpening operation on a blade 1070 with opposing sides 1072, 1074 and centerline 1070A. The tip of the blade has curvilinearly extending surfaces (convex bevels) 1076, 1078. These convex bevels are imparted by a sharpening member 1080 having compliant sharpening layer 1082 and backing layer 1084. As shown in FIG. 36A, the layers 1082, 1084 are deformable, enabling the sharpening operation to impart a convex geometry to the blade. As discussed above, the blade is rotated 180 degrees so that the sharpening member 1080 is applied to each of the sides 1072, 1074 in turn in order to generate the respective convex surfaces 1076 and 1078 that intersect to form cutting edge 1080A.

FIG. 36A shows the first sharpening operation to be carried out at a first level of compliance where the resulting convex bevels 1076, 1078 are at a first amount of curvature. FIG. 36B shows the blade 1070 after a second (fine) sharpening operation at a second level of compliance where the resulting convex bevels are at a second amount of curvature. Sharpened beveled regions 1096 and 1098 have a greater amount of curvature as compared to the surfaces 1076, 1078 shown in FIG. 36A. An abrasive member 1100 with compliant abrasive layer 1102 and backing layer 1104 are supplied to generate the respective convex bevels 1096, 1098 that intersect to form cutting edge 1100A.

Figure 37:
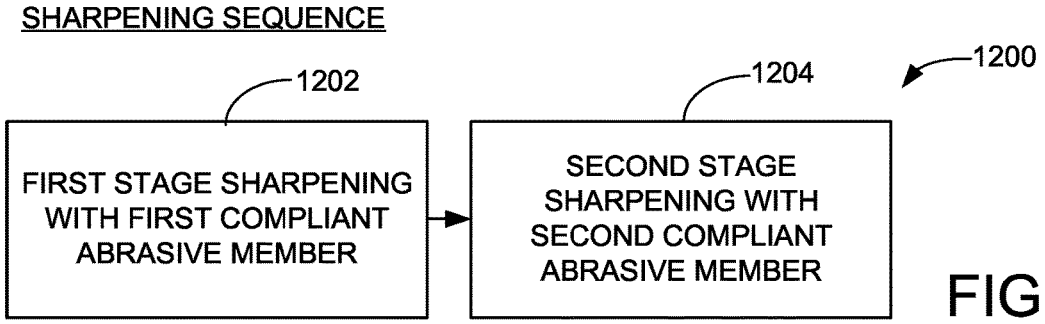
FIG. 37 is a sequence diagram to illustrate steps carried out using the compliant abrasive assembly of FIGS. 36A and 36B.

FIG. 37 is a flow diagram 1200 to generally represent the sharpening progression of FIGS. 36A-36B. Block 1202 represents the first (coarse) sharpening operation carried out using the first sharpening member 1080, and block 1204 represents the second (fine) sharpening operation using the second sharpening member 1100.

It is contemplated that the relatively lower compliance of sharpening member 1080 produces a relatively coarse cutting edge 1080A during block 1202. Subsequent progression to the fine sharpening member 1100 with increased compliance at block 1204 provides a relatively increased curvature at the tip of the blade 1070 by removing cutting edge 1080A and forming a new relatively finer cutting edge 1100A. This increase in curvature between sharpening members permits the quick refinement of the cutting edge. While two sharpening operations are depicted, it will be appreciated that any number of such operations can be successively applied to each side of the blade in turn.

It will now be understood that the various embodiments presented herein present a number of advantages and benefits over the existing art. The blade fixture as embodied herein provides an effective and secure clamping mechanism to enable repeatable clamping of a blade to be sharpened. The abrasive assembly as embodied herein enables user selection of one or more different abrasive surfaces as well as a safe and effective mechanism for user manipulation of the abrasive away from the cutting edge. The base assembly provides precise adjustments of sharpening angle, as well as safe and convenient rotation of the cutting edge to enable opposing sides of the blade to be quickly and easily sharpened.

It is to be understood that even though numerous characteristics and advantages of various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. An abrasive assembly for sharpening a cutting edge of a cutting tool, the abrasive assembly comprising:

a frame comprising a longitudinally extending base portion having opposing proximal and distal ends, a first flange extending from the proximal end, a second flange extending from the distal end, and a user handle;

an abrasive cartridge secured between the first and second flanges and configured for independent rotation with respect to the frame about a cartridge axis parallel to the longitudinally extending base portion, the abrasive cartridge comprising a plurality of abrasive members with associated abrasive surfaces, each of the associated abrasive surfaces selectable with respect to the user handle, by a user, to be presented in a facing relation to the cutting tool;

a locking feature comprising at least one groove and a corresponding locking tab configured to retain at least a selected one of the plurality of abrasive members in said facing relation to the cutting tool at a fixed rotational position upon rotation of the abrasive cartridge within the frame and engagement of the locking tab with the at least one groove; and a swing-arm rod extending from the frame along a rod axis and configured for attachment to a base assembly to facilitate movement of the user selected abrasive surface along the cutting edge of the cutting tool responsive to engagement, by the user, of the user handle.

2. The abrasive assembly of claim 1, wherein the abrasive cartridge comprises a main body which supports a plurality of different abrasive members with associated abrasive surfaces, and wherein the locking feature comprises a corresponding plurality of grooves to enable presentation, in a locked position, of each of the plurality of different abrasive members in turn against the cutting tool.

3. The abrasive assembly of claim 2, wherein the main body has a substantially triangular cross-sectional shape and supports a total of three abrasive members having associated abrasive surfaces with different abrasiveness levels configured to carry out respective coarse, fine and honing sharpening operations upon the cutting edge of the cutting tool.

4. The abrasive assembly of claim 1, wherein the cartridge axis is coaxial with the rod axis so that the rod extends through the abrasive cartridge and through the respective first and second flanges.

5. The abrasive assembly of claim 1, wherein the at least one groove is a detent in the abrasive cartridge, and wherein the locking feature further comprises a spring activated finger that engages the detent in the abrasive cartridge to secure the abrasive cartridge from rotation with respect to the frame.

6. The abrasive assembly of claim 1, wherein the user handle is disposed in a medial portion of the longitudinally extending base portion of the frame opposite a selected abrasive surface selected by the user to be presented in facing relation to the cutting tool so that the user handle is in a first side of the rod axis and the selected abrasive surface is on an opposing, second side of the rod axis.

7. The abrasive assembly of claim 1, in combination with an adjustment mechanism which engages the base assembly and to which a distal end of the rod is coupled to establish a selected sharpening angle at which the abrasive surface is presented against the cutting edge.

8. The abrasive assembly of claim 1, in combination with the base assembly and a fixture which clamps opposing sides of the cutting tool and which is inserted into a receiving slot of the base assembly to maintain the cutting tool at a selected orientation to facilitate sharpening thereof by user movement of the abrasive assembly, via the user handle, along the cutting edge.

9. An apparatus comprising:

a frame comprising a longitudinally extending base portion having opposing proximal and distal ends, a first flange extending downwardly from the proximal end, a second flange extending downwardly from the distal end, and a user handle coupled to the longitudinally extending base portion;

an abrasive cartridge supported by the frame between the first and second flanges comprising a plurality of abrasive members each having an associated abrasive surface, the abrasive cartridge rotatable within the frame about a cartridge axis to a series of locked positions each presenting a different selected abrasive surface in a facing relation with a cutting tool using a locking feature of the frame comprising at least one groove and at least one locking tab extendable into the at least one groove; and a swing-arm rod extending from the frame along a rod axis and configured for attachment to a base assembly to facilitate movement of the selected abrasive surface along a cutting edge of the cutting tool responsive to engagement, by a user, of the user handle.

10. The apparatus of claim 9, wherein the cartridge axis is coaxial with the rod axis and the swing-arm rod extends through the abrasive cartridge and the respective first and second flanges.

11. The apparatus of claim 9, wherein at least one of the plurality of abrasive members is characterized as a compliant abrasive member.

12. The apparatus of claim 9, wherein the longitudinally extending base portion of the frame spans an overall length of the abrasive cartridge and the user handle is disposed in a medial location of and extends upwardly from the longitudinally extending base portion.

13. The apparatus of claim 9, wherein the locking feature comprises a plurality of grooves each proximate a different one of the abrasive surfaces and at least one projection configured for engagement with at least a selected one of the plurality of grooves to lock the abrasive cartridge in a selected rotational orientation with respect to the frame.

14. The apparatus of claim 9, wherein the cartridge comprises a main body with a substantially triangular cross-sectional shape and which supports a total of three abrasive members of said plurality of abrasive members each having associated abrasive surfaces with different abrasiveness levels configured to carry out respective coarse, fine and honing sharpening operations upon the cutting edge of the cutting tool.

15. The apparatus of claim 9, wherein the locking feature comprises a spring activated finger that engages a corresponding detent in the cartridge to secure the cartridge with respect to the frame.

16. The apparatus of claim 9, characterized as an abrasive assembly and in combination with a base assembly configured to receivingly engage a distal end of the swing-arm rod, and further in combination with a fixture which clamps opposing sides of the cutting tool and which is inserted into a receiving slot of the base assembly to maintain the cutting tool at a selected orientation, the combination configured to facilitate sharpening of the cutting edge of the cutting tool by user movement of the abrasive assembly, via the user handle, along the cutting edge, via an arcuate motion along a path defined by the swing-arm rod.

17. An abrasive assembly for sharpening a cutting edge of a cutting tool, the abrasive assembly comprising:

a frame comprising a longitudinally extending base portion having opposing proximal and distal ends, a first flange extending from the proximal end, a second flange extending from the distal end, and a user handle extending from the longitudinally extending base portion;

an abrasive cartridge disposed between the first and second flanges of the frame comprising a plurality of abrasive members with associated abrasive surfaces, the abrasive cartridge configured for independent rotation within the frame about a cartridge axis with respect to the frame to each of a succession of locked positions to facilitate presentation of each of the abrasive surfaces in facing relation to the cutting tool in turn using a locking feature comprising a corresponding plurality of grooves and at least one locking tab which selectively extends into each of the plurality of grooves in turn; and a swing-arm rod that extends through the abrasive cartridge and each of the first and second flanges.

18. The abrasive assembly of claim 17, wherein the swing-arm rod extends along a rod axis and is configured for attachment to a base assembly to facilitate movement of the selected abrasive surface along the cutting edge of the cutting tool responsive to engagement, by a user, of the user handle.

19. The abrasive assembly of claim 17, wherein the locking feature comprises a spring biased feature and corresponding detent notch that secures the abrasive cartridge in a selected rotational orientation with respect to the frame.

20. The abrasive assembly of claim 17, wherein the abrasive cartridge comprises opposing rotational shafts that engage corresponding recesses in opposing ends of the frame to facilitate the rotation of the abrasive cartridge about the cartridge axis.

21. The abrasive assembly of claim 17, wherein the abrasive cartridge is configured to be removably replaceable with respect to the frame.

* * * * *